US011421311B2

(12) United States Patent
Ferrasse et al.

(10) Patent No.: US 11,421,311 B2
(45) Date of Patent: Aug. 23, 2022

(54) ECAE MATERIALS FOR HIGH STRENGTH ALUMINUM ALLOYS

(71) Applicant: Honeywell International Inc., Charlotte, NC (US)

(72) Inventors: Stephane Ferrasse, Spokane, WA (US); Wayne D. Meyer, Cheney, WA (US); Frank C. Alford, Spokane Valley, WA (US); Marc D. Ruggiero, Liberty Lake, WA (US); Patrick K. Underwood, Spokane, WA (US); Susan D. Strothers, Mead, WA (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/090,312

(22) Filed: Nov. 5, 2020

(65) Prior Publication Data

US 2021/0054490 A1 Feb. 25, 2021

Related U.S. Application Data

(62) Division of application No. 15/824,283, filed on Nov. 28, 2017, now Pat. No. 10,851,447.

(Continued)

(51) Int. Cl.

*C22F 1/047* (2006.01)
*C22F 1/053* (2006.01)

(Continued)

(52) U.S. Cl.

CPC ..... *C22F 1/053* (2013.01); *C22C 21/02* (2013.01); *C22C 21/06* (2013.01); *C22C 21/10* (2013.01);

(Continued)

(58) Field of Classification Search

None

See application file for complete search history.

(56) References Cited

U.S. PATENT DOCUMENTS 4,770,484 A 9/1988 Mori
4,770,848 A 9/1988 Ghosh et al.

(Continued)

FOREIGN PATENT DOCUMENTS

CN 1459512 A 12/2003
CN 1918311 A 2/2007

(Continued)

OTHER PUBLICATIONS

Zhao, Y.H. et al., "Microstructures and mechanical properties of ultrfine grained 7075 Al alloy processed by ECAP and their evolutions during annealing", Acta Materialia, vol. 52, pp. 4589-4599, available online Jul. 2, 2004.*

(Continued)

*Primary Examiner* — George Wyszomierski

(74) *Attorney, Agent, or Firm* — Faegre Drinker Biddle & Reath LLP

(57) ABSTRACT

Disclosed herein is a method of forming a high strength aluminum alloy. The method comprises heating an aluminum material to a solutionizing temperature for a solutionizing time such that the magnesium and zinc are dispersed throughout the extruded aluminum material to form a solutionized aluminum material. The method includes quenching the solutionized aluminum material to form a quenched aluminum material. The method also includes aging the quenched aluminum material to form an aluminum alloy, then subjecting the aluminum alloy to an ECAE process to form a high strength aluminum alloy.

20 Claims, 20 Drawing Sheets

Related U.S. Application Data

(60) Provisional application No. 62/503,111, filed on May 8, 2017, provisional application No. 62/429,201, filed on Dec. 2, 2016.

(51) Int. Cl.

| | |
|---|---|
| ***C22F 1/057*** | (2006.01) |
| ***C22F 1/00*** | (2006.01) |
| ***C22C 21/02*** | (2006.01) |
| ***C22C 21/06*** | (2006.01) |
| ***C22C 21/10*** | (2006.01) |
| ***C22F 1/043*** | (2006.01) |
| *B21C 23/00* | (2006.01) |

(52) U.S. Cl.

CPC ..... *C22F 1/002* (2013.01); *C22F 1/043* (2013.01); *C22F 1/047* (2013.01); *C22F 1/057* (2013.01); *B21C 23/001* (2013.01); *B21C 23/002* (2013.01)

(56) References Cited

U.S. PATENT DOCUMENTS

| | | | | |
|---|---|---|---|---|
| 5,513,512 | A | 5/1996 | Segal | |
| 5,620,537 | A | 4/1997 | Bampton | |
| 5,826,456 | A | 10/1998 | Kawazoe et al. | |
| 7,017,382 | B2 | 3/2006 | Segal et al. | |
| 7,296,453 | B1 | 11/2007 | Oruganti et al. | |
| 7,971,464 | B2 | 7/2011 | Hachino et al. | |
| 8,028,558 | B2 | 10/2011 | Segal | |
| 8,137,755 | B2 | 3/2012 | Keener et al. | |
| 8,535,505 | B2 | 9/2013 | Yi et al. | |
| 9,265,169 | B2 | 2/2016 | Zhou et al. | |
| 2002/0017344 | A1 | 2/2002 | Gupta et al. | |
| 2005/0094280 | A1 | 5/2005 | Ahn et al. | |
| 2006/0237134 | A1 | 10/2006 | Keener et al. | |
| 2007/0084527 | A1 | 4/2007 | Ferrasse et al. | |
| 2007/0169861 | A1 | 7/2007 | Bischofberger | |
| 2008/0196801 | A1 | 8/2008 | Zhao et al. | |
| 2009/0020192 | A1 | 1/2009 | Segal et al. | |
| 2010/0319820 | A1* | 12/2010 | Koma ..... | C22F 1/043 148/695 |
| 2012/0085470 | A1 | 4/2012 | Segal | |
| 2013/0216852 | A1 | 8/2013 | Hsu et al. | |
| 2014/0190739 | A1 | 7/2014 | Zhou et al. | |
| 2014/0248177 | A1 | 9/2014 | Kamat | |
| 2015/0090373 | A1 | 4/2015 | Gable et al. | |
| 2015/0354045 | A1 | 12/2015 | Gable et al. | |
| 2016/0002805 | A1 | 1/2016 | Browning et al. | |
| 2016/0115575 | A1 | 4/2016 | Bull et al. | |
| 2016/0221318 | A1 | 8/2016 | Ramsden | |
| 2016/0237530 | A1 | 8/2016 | Roy et al. | |
| 2016/0355917 | A1 | 12/2016 | Kawamura et al. | |
| 2017/0023706 | A1 | 1/2017 | Yang et al. | |
| 2017/0101705 | A1 | 4/2017 | Mohanty et al. | |
| 2018/0155811 | A1 | 6/2018 | Ferrasse et al. | |
| 2018/0155812 | A1 | 6/2018 | Ferrasse et al. | |
| 2020/0131611 | A1 | 4/2020 | Ferrasse et al. | |
| 2020/0270730 | A1 | 8/2020 | Ferrasse et al. | |

FOREIGN PATENT DOCUMENTS

| | | | |
|---|---|---|---|
| CN | 101690957 | B | 3/2012 |
| CN | 102925827 | A | 2/2013 |
| CN | 103060730 | A | 4/2013 |
| CN | 103909690 | A | 7/2014 |
| CN | 105331858 | A | 2/2016 |
| CN | 105339515 | A | 2/2016 |
| CN | 205556754 | U | 9/2016 |
| CN | 107502841 | A | 12/2017 |
| CN | 108468005 | A | 8/2018 |
| DE | 102008033027 | A1 | 3/2010 |
| EP | 2822717 | A1 | 1/2015 |
| GB | 0751125 | A | 6/1956 |
| JP | 09-137244 | A | 5/1997 |
| JP | 10-258334 | A | 9/1998 |
| JP | 11-114618 | A | 4/1999 |
| JP | 2000-271631 | A | 10/2000 |
| JP | 2000-271695 | A | 10/2000 |
| JP | 2004-176134 | A | 6/2004 |
| JP | 2008-196009 | A | 8/2008 |
| JP | 4753240 | B2 | 8/2011 |
| JP | 4920455 | B2 | 4/2012 |
| JP | 5202038 | B2 | 6/2013 |
| KR | 10-2005-0073316 | A | 7/2005 |
| KR | 10-0623662 | B1 | 7/2005 |
| KR | 10-2005-0105825 | A | 11/2005 |
| KR | 2005-0105825 | A | 11/2005 |
| KR | 0623662 | B1 | 9/2006 |
| KR | 10-0778763 | B1 | 11/2007 |
| KR | 0778763 | B1 | 11/2007 |
| KR | 10-2009-0115471 | A | 11/2009 |
| KR | 10-2009-0118404 | A | 11/2009 |
| KR | 2009-0118404 | A | 11/2009 |
| KR | 10-2014-0041285 | A | 4/2014 |
| KR | 2014-0118304 | A | 10/2014 |
| KR | 2015-0001463 | A | 1/2015 |
| RU | 2235799 | C1 | 9/2004 |
| RU | 2396368 | C2 | 8/2010 |
| RU | 2468114 | C1 | 11/2012 |
| RU | 2571993 | C1 | 12/2015 |
| TW | 200540956 | A | 12/2005 |
| WO | 01/44536 | A2 | 6/2001 |
| WO | 2005/094280 | A2 | 10/2005 |
| WO | 2010/087074 | A1 | 8/2010 |
| WO | 2013/133976 | A1 | 9/2013 |
| WO | 2014/010678 | A1 | 1/2014 |
| WO | 2016/092135 | A1 | 6/2016 |
| WO | 2017/014990 | A1 | 1/2017 |
| WO | 2017/106665 | A1 | 6/2017 |
| WO | 2017/108986 | A1 | 6/2017 |
| WO | 2018/080710 | A1 | 5/2018 |
| WO | 2018/102328 | A1 | 6/2018 |

OTHER PUBLICATIONS

"A Critical Evaluation of the Processing and Properties of Ultrafine-Grained Materials Pmduced by Intense Piastic Straining." National Science Foundation, Award Abstract #9625969, Investigatior Terrence Langdon, Last amendment date is Jan. 8, 1998, 3 pages.

"IK500 High-Strength Die Casting Aluminum Alloy," Brochure. Interplex Quantum Co., Ltd., 2 pages, Available at least as early as Aug. 1, 2016.

Birol, Y. (2004). The effect of homogenization practice on the microstructure of AA6063 billets. Journal of Materials Processing Technology, 148:250-258.

Duan, Zlli Chao; et al. "Developing Processing Routes for the Equal-Channel Angular Pressing of Age-Hardenable Aluminum Alloys." Metallurgical and Materials Transactions A, vol. 41A:802-809, Apr. 2010.

Gao, Nong; et al. "Evolution of Microstructure and Precipitation in Heat-Treatable Aluminum Alloys During ECA Pressing and Subsequent Heat Treatment." Materials Science Forum, vols. 503-504, pp. 275-280, Jan. 15, 2006.

International Search Report and Written Opinion received for PCT Patent Application No. PCT/US2017/063550, dated Feb. 8, 2018, 10 pages.

International Search Report and Written Opinion received for PCT Patent Application No. PCT/US2017/063562, dated Mar. 14, 2018, 9 pages.

International Search Report and Written Opinion received for PCT Patent Application No. PCT/US2019/056707, dated Feb. 7, 2020, 12 pages.

Kanetake, N.; et al. "Upgrading in Mechanical Properties of High Performance Aluminum Alloys By Compressive Torsion Process." International Conference on Manufacture of Lightweight Components—Manulight2014, Procedia CIRP, 18:57-61, 2014.

Ma, K. et al., "Mechanical behavior and strengthening mechanisms in ultrafine grain precipitation-strengthened aluminum alloy", Acta Materialia, vol. 62, pp. 141-155, available online Oct. 24, 2013.

(56) References Cited

OTHER PUBLICATIONS

Mishra, Rajiv S. "Processing Commercial Aluminum Alloys for High Strain Rate Superplasticity," JOM, Superplasticity, Overview, Mar. 2001, pp. 23-26.
Murashkin, M. Yu.; et al. "Strength of Commerical Aluminum Alloys After Equal Channel Angular Pressing and Post-ECAP Processing." Solid State Phenomena, 114:91-96, 2006.
Namoru Mabuchi et al. microstructure and mechnical properties of 5056 Al alloy processed by equal channel angular extrusion, Nanostructured Materials, vol. 8, No. 8, Dec. 1997, pp. 1105-1111.
Ruppert, M; et al. "Mechanical Properties of Ultrafine-Gralned AlZnMg(Cu)-Alloys AA7020 and AA7075 Processed by Accumulative Roll Bonding." J. Mater Sci., 50:4422-4429, 2015.
Segal, Vladimir M. "Fabrication of High-Strength Lightweight Metals for Armor and Structural Applications." Engineered Performance Materials Company, Llc, US Army Research Laboratory, Phase I Finai Report, Award Period of Jan. 27, 2011 to Mar. 8, 2012, 5 pages.
Shaban, M ; et al. "Plastic Deformation of 7075 Aluminum Alloy Using integrated Extrusion-Equal Channel Angular Pressing." Journal of Advanced Materials and Processing, 4(1):30-37, 2016.
Showa Denko K.K., "Showa Denko Develops High-Strength Version of ST60 Aluminum Plate," Published Apr. 25, 2016 [online], [retrieved on May 21, 2018], Retrieved from the Internet <http://www.sdk.co.jp/english/news/2016/12589.html>.
Sun, Yiwei et al. (2014). Effect of Mg2Si Phase on Extrusion of AA6005 Aluminum Alloy. Light Metals; The Minerals, Metals & Materials Society, pp. 429-433.
Ferrasse, S. et al., "Development of a submicrometer-grained microstructure in aluminum 6061 using equal channel angular extrusion", Journal of Materials Research, vol. 12, No. 5, pp. 1253-1261, May 1997.
BBS, "Hardness Conversion Table—Tensile Strength, Vickers, Brinell OCH Rockwell," Jun. 11, 2021.

* cited by examiner

ECAE MATERIALS FOR HIGH STRENGTH ALUMINUM ALLOYS

CROSS-REFERENCE TO RELATED APPLICATION

This application is a Divisional Application of U.S. application Ser. No. 15/824,283, filed Nov. 28, 2018, which claims priority to Provisional Application No. 62/429,201, filed Dec. 2, 2016 and also claims priority to Provisional Application No. 62/503,111, filed May 8, 2017, all of which are herein incorporated by reference in their entireties.

TECHNICAL FIELD

The present disclosure relates to high-strength aluminum alloys which may be used, for example, in devices requiring high yield strength. More particularly, the present disclosure relates to high-strength aluminum alloys that have high yield strength and which may be used to form cases or enclosures for electronic devices. Methods of forming high-strength aluminum alloys and high-strength aluminum cases or enclosures for portable electronic devices are also described.

BACKGROUND

There is a general trend toward decreasing the size of certain portable electronic devices, such as laptop computers, cellular phones, and portable music devices. There is a corresponding desire to decrease the size of the outer case or enclosure that holds the device. As an example, certain cellular phone manufacturers have decreased the thickness of their phone cases, for example, from about 8 mm to about 6 mm. Decreasing the size, such as the thickness, of the device case may expose the device to an increased risk of structural damage, both during normal use and during storage between uses, specifically due to device case deflection. Users handle portable electronic devices in ways that put mechanical stresses on the device during normal use and during storage between uses. For example, a user putting a cellular phone in a back pocket of his pants and sitting down puts mechanical stress on the phone which may cause the device to crack or bend. There is thus a need to increase the strength of the materials used to form device cases in order to minimize elastic or plastic deflection, dents, and any other types of damage.

SUMMARY

Disclosed herein is a method of forming a high strength aluminum alloy. The method comprises heating an aluminum material containing magnesium and zinc to a solutionizing temperature for a solutionizing time such that the magnesium and zinc are dispersed throughout the extruded aluminum material to form a solutionized aluminum material. The method includes quenching the solutionized aluminum material to below about room temperature such that the magnesium and zinc remain dispersed throughout the solutionized aluminum material to form a quenched aluminum material. The method further includes aging the quenched aluminum material to form an aluminum alloy. The method also includes subjecting the aluminum alloy to an ECAE process while maintaining the aluminum alloy at a temperature to produce a high strength aluminum alloy.

Also disclosed herein is a method forming a high strength aluminum alloy comprising subjecting an aluminum material containing magnesium and zinc to a first equal channel angular extrusion (ECAE) process while maintaining the aluminum material at a temperature between about 100° C. to about 400° C. to produce an extruded aluminum material. The method also includes heating the extruded aluminum material to a solutionizing temperature for a solutionizing time such that the magnesium and zinc are dispersed throughout the extruded aluminum material to form a solutionized aluminum material. The method includes quenching the solutionized aluminum material to below about room temperature such that the magnesium and zinc remain dispersed throughout the solutionized aluminum material to form a quenched aluminum material. The method includes subjecting the quenched aluminum material to a second ECAE process while maintaining the aluminum alloy at a temperature between about 20° C. and 150° C. to form a high strength aluminum alloy.

Also disclosed herein is a high strength aluminum alloy material comprising an aluminum material containing aluminum as a primary component. The aluminum material contains from about 0.5 wt. % to about 4.0 wt. % magnesium and from about 2.0 wt. % to about 7.5 wt. % zinc by weight. The aluminum material has an average grain size from about 0.2 μm to about 0.8 μm and an average yield strength greater than about 300 MPa.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Disclosed herein is a method of forming an aluminum (Al) alloy that has high yield strength. More particularly, described herein is a method of forming an aluminum alloy that has a yield strength from about 400 MPa to about 650 MPa. In some embodiments, the aluminum alloy contains aluminum as a primary component and magnesium (Mg) and/or zinc (Zn) as secondary components. For example, aluminum may be present in an amount greater than an amount of magnesium and/or zinc. In other examples, aluminum may be present at a weight percentage of greater than about 70 wt. %, greater than about 80 wt. %, or greater than about 90 wt. %. Methods of forming a high strength aluminum alloy including by equal channel angular extrusion (ECAE) are also disclosed. Methods of forming a high strength aluminum alloy having a yield strength from about 400 MPa to about 650 MPa, including by equal channel angular extrusion (ECAE) in combination with certain heat treatment processes, are also disclosed. In some embodiments, the aluminum alloy may be cosmetically appealing. For example, the aluminum alloy may be free of a yellow or yellowish color.

In some embodiments, the methods disclosed herein may be carried out on an aluminum alloy having a composition containing Zinc in the range from 2.0 wt. % to 7.5 wt. %, from about 3.0 wt. % to about 6.0 wt. %, or from about 4.0 wt. % to about 5.0 wt. %; and Magnesium in the range from 0.5 wt. % to about 4.0 wt. %, from about 1.0 wt. % to 3.0 wt %, from about 1.3 wt. % to about 2.0 wt. %. In some embodiments, the methods disclosed herein may be carried out with an aluminum alloy having a Zinc/Magnesium weight ratio from about 3:1 to about 7:1, from about 4:1 to about 6:1, or about 5:1. In some embodiments, the methods disclosed herein may be carried out on an aluminum alloy having Magnesium and Zinc and having copper (Cu) in limited concentrations, for example, Copper at a concentration of less than 1.0 wt. %, less than 0.5 wt. %, less than 0.2 wt. %, less than 0.1 wt. %, or less than 0.05 wt. %.

In some embodiments, the methods disclosed herein may be carried out with an aluminum-zinc alloy. In some embodiments, the methods disclosed herein may be carried out with an aluminum alloy in the A17000 series and form an aluminum alloy having a yield strength from about 400 MPa to about 650 MPa, from about 420 MPa to about 600 MPa, or from about 440 MPa to about 580 MPa. In some embodiments, the methods disclosed herein may be carried out with an aluminum alloy in the A17000 series and form an aluminum alloy having a submicron grain size less than 1 micron in diameter.

Figure 1:
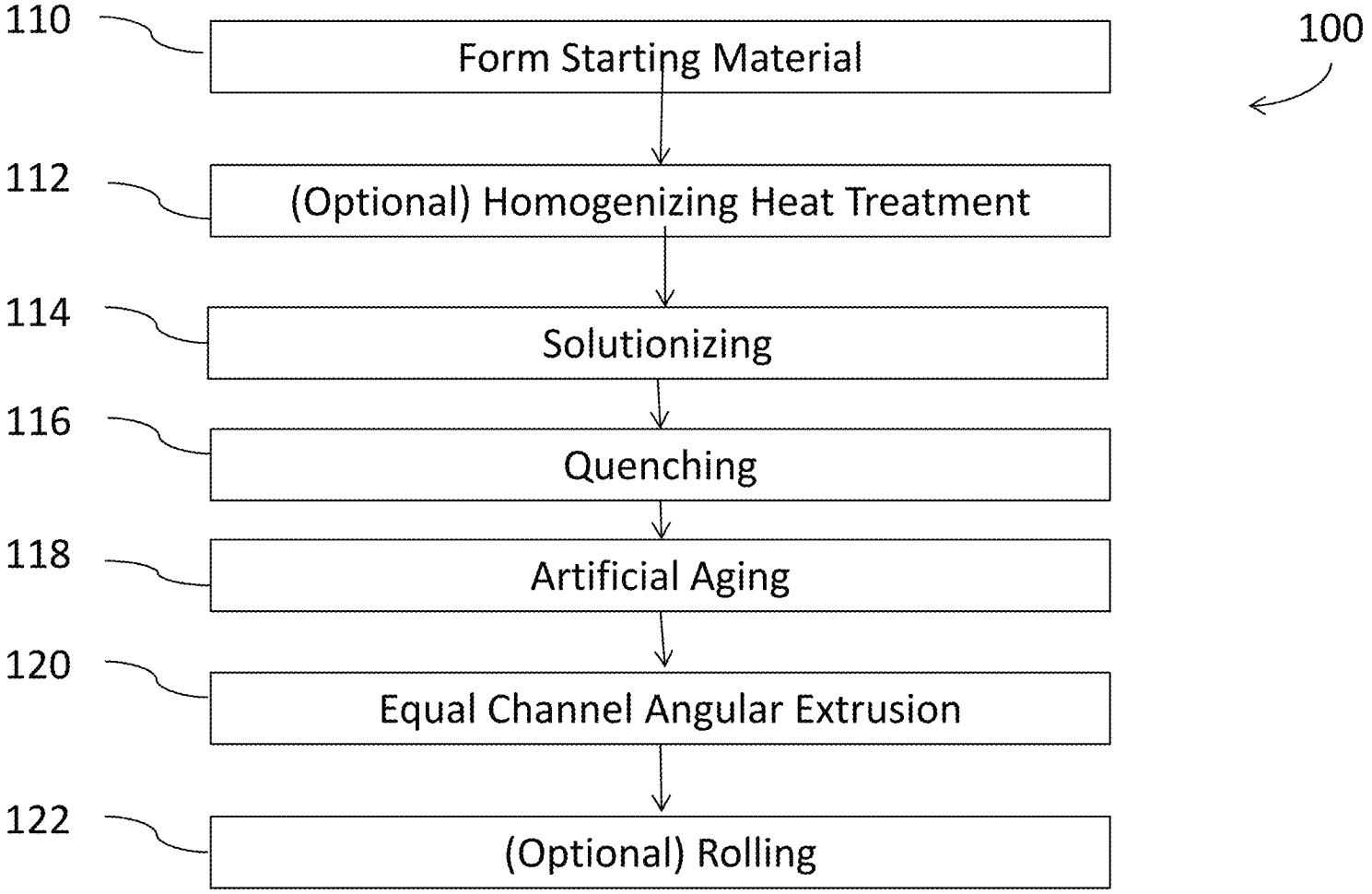
FIG. 1 is a flow chart showing an embodiment of a method of forming a high-strength aluminum alloy.

A method 100 of forming a high strength aluminum alloy having Magnesium and Zinc is shown in FIG. 1. The method 100 includes forming a starting material in step 110. For example, an aluminum material may be cast into a billet form. The aluminum material may include additives, such as other elements, which will alloy with aluminum during method 100 to form an aluminum alloy. In some embodiments, the aluminum material billet may be formed using standard casting practices for an aluminum alloy having Magnesium and Zinc, such as an aluminum-zinc alloy.

After formation, the aluminum material billet may optionally be subjected to a homogenizing heat treatment in step 112. The homogenizing heat treatment may be applied by holding the aluminum material billet at a suitable temperature above room temperature for a suitable time to improve the aluminum's hot workability in following steps. The temperature and time of the homogenizing heat treatment may be specifically tailored to a particular alloy. The temperature and time may be sufficient such that the magnesium and zinc are dispersed throughout the aluminum material to form a solutionized aluminum material. For example, the magnesium and zinc may be dispersed throughout the aluminum material such that the solutionized aluminum material is substantially homogenous. In some embodiments, a suitable temperature for the homogenizing heat treatment may be from about 300° C. to about 500° C. The homogenizing heat treatment may improve the size and homogeneity of the as-cast microstructure that is usually dendritic with micro and macro segregations. Certain homogenizing heat treatments may be performed to improve structural uniformity and subsequent workability of billets. In some embodiments, a homogenizing heat treatment may lead to the precipitation occurring homogenously, which may contribute to a higher attainable strength and better stability of precipitates during subsequent processing.

After the homogenizing heat treatment, the aluminum material billet may be subjected to solutionizing in step 114. The goal of solutionizing is to dissolve the additive elements, such as Zinc, Magnesium, and Copper, into the aluminum material to form an aluminum alloy. A suitable solutionizing temperature may be from about 400° C. to about 550° C., from about 420° C. to about 500° C., or from about 450° C. to about 480° C. Solutionizing may be carried out for a suitable duration based on the size, such as the cross sectional area, of the billet. For example, the solutionizing may be carried out for from about 30 minutes to about 8 hours, from 1 hour to about 6 hours, or from about 2 hours to about 4 hours, depending on the cross section of the billet. As an example, the solutionizing may be carried out at 450° C. to about 480° C. for up to 8 hours.

The solutionizing may be followed by quenching, as shown in step 116. For standard metal casting, heat treatment of a cast piece is often carried out near the solidus temperature (i.e. solutionizing) of the cast piece, followed by rapidly cooling the cast piece by quenching the cast piece to about room temperature or lower. This rapid cooling retains any elements dissolved into the cast piece at a higher concentration than the equilibrium concentration of that element in the aluminum alloy at room temperature.

In some embodiments, after the aluminum alloy billet is quenched, artificial aging may be carried out, as shown in step 118. Artificial aging may be carried out using a two-step heat treatment. In some embodiments, a first heat treatment step may be carried out at temperatures from about 80° C.

to about 100° C., from about 85° C. to about 95° C., or from about 88° C. to about 92° C., for a duration of from 1 hour to about 50 hours, from about 8 hours to about 40 hours, or from about 10 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first step may be carried out at about 90° C. for about 8 hours and the second step may be carried out at about 115° C. for about 40 hours or less. Generally, a first artificial aging heat treatment step may be carried out at a lower temperature and for less time than the temperature and duration that the second artificial aging heat treatment step is carried out at. In some embodiments, the second artificial aging heat treatment step may include temperatures and time that are less than or equal to conditions suitable for artificially aging an aluminum alloy having Magnesium and Zinc to peak hardness, i.e. peak aging.

After artificial aging, the aluminum alloy billet may be subjected to severe plastic deformation such as equal channel angular extrusion (ECAE), as shown in step 120. For example, the aluminum alloy billet may be passed through an ECAE device to extrude the aluminum alloy as a billet having a square or circular cross section. The ECAE process may be carried out at relatively low temperatures compared to the solutionizing temperature of the particular aluminum alloy being extruded. For example, ECAE of an aluminum alloy having Magnesium and Zinc may be carried out at a temperature of from about 0° C. to about 160° C., or from about 20° C. to about 125° C., or about room temperature, for example, from about 20° C. to about 35° C. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the ECAE process may include one pass, two or more passes, or four or more extrusion passes through the ECAE device.

Following severe plastic deformation by ECAE, the aluminum alloy may optionally undergo further plastic deformation, such as rolling in step 122, to further tailor the aluminum alloy properties and/or change the shape or size of the aluminum alloy. Cold working (such as stretching) may be used to provide a specific shape or to stress relief or straighten the aluminum alloy billet. For plate applications where the aluminum alloy is to be a plate, rolling may be used to shape the aluminum alloy.

Figure 2:
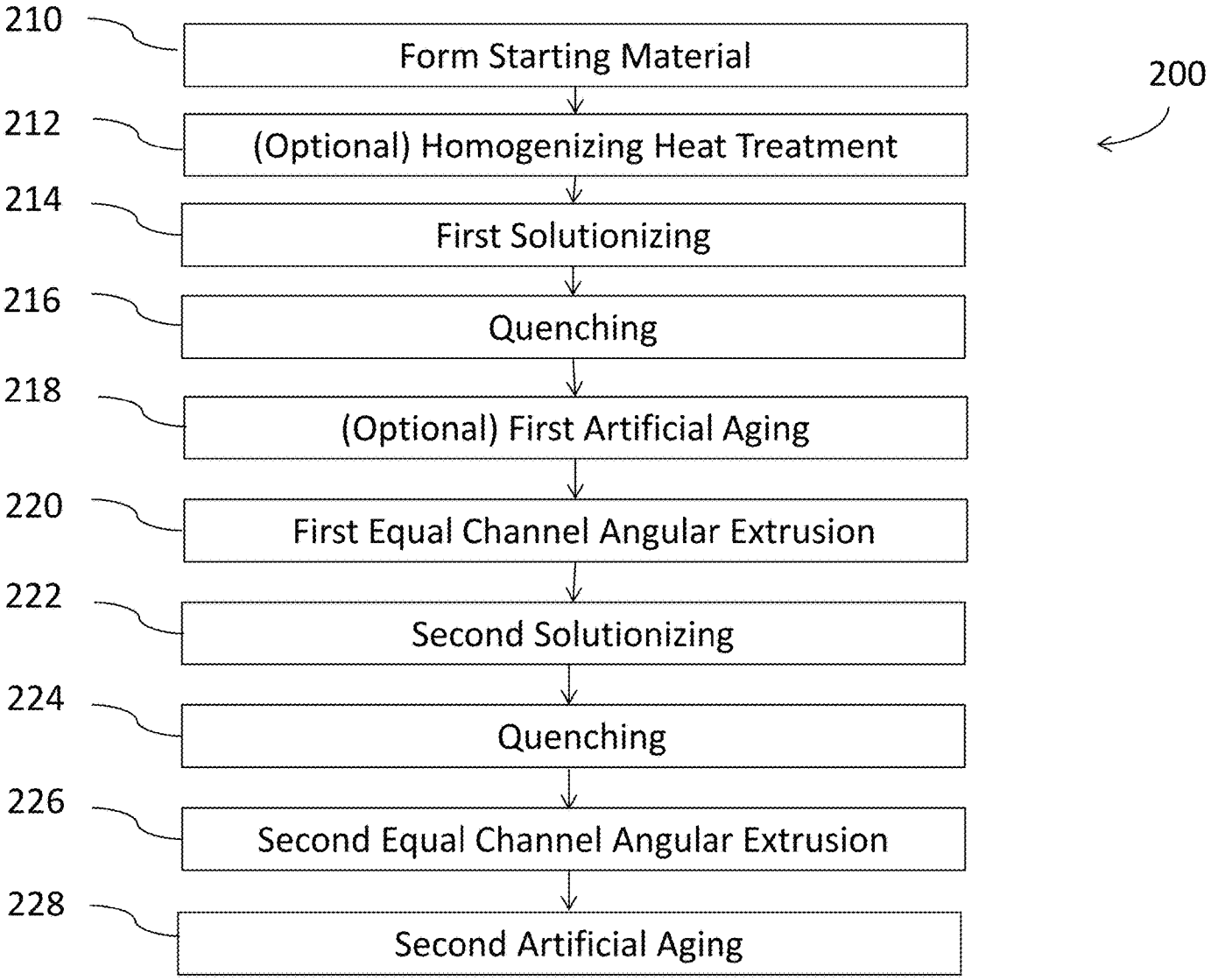
FIG. 2 is a flow chart showing an alternative embodiment of a method of forming a high-strength aluminum alloy.

FIG. 2 is a flow chart of a method 200 of forming a high strength aluminum alloy. The method 200 includes forming a starting material in step 210. Step 210 may be the same as or similar to step 110 described herein with respect to FIG. 1. In some embodiments, the starting material may be an aluminum material billet formed using standard casting practices for an aluminum material having Magnesium and Zinc, such as aluminum-zinc alloys.

The starting material may be optionally subjected to a homogenizing heat treatment in step 212. This homogenizing heat treatment may be applied by holding the aluminum material billet at a suitable temperature above room temperature to improve the aluminum's hot workability. Homogenizing heat treatment temperatures may be in the range of 300° C. to about 500° C. and may be specifically tailored to particular aluminum alloys.

After the homogenizing heat treatment, the aluminum material billet may be subjected to a first solutionizing in step 214. The goal of solutionizing is to dissolve the additive elements, such as Zinc, Magnesium, and Copper, to form an aluminum alloy. A suitable first solutionizing temperature may be from about 400° C. to about 550° C., from about 420° C. to about 500° C., or from about 450° C. to about 480° C. Solutionizing may be carried out for a suitable duration based on the size, such as the cross sectional area, of the billet. For example, the first solutionizing may be carried out for from about 30 minutes to about 8 hours, from 1 hour to about 6 hours, or from about 2 hours to about 4 hours, depending on the cross section of the billet. As an example, the first solutionizing may be carried out at 450° C. to about 480° C. for up to 8 hours.

The first solutionizing may be followed by quenching, as shown in step 216. This rapid cooling retains any elements dissolved into the cast piece at a higher concentration than the equilibrium concentration of that element in the aluminum alloy at room temperature.

In some embodiments, after the aluminum alloy billet is quenched, artificial aging may optionally be carried out in step 218. Artificial aging may be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first step may be carried out at about 90° C. for about 8 hours and the second step may be carried out at about 115° C. for about 40 hours or less. Generally, a first artificial aging heat treatment step may be carried out at a lower temperature and for less time than the temperature and duration that the second artificial aging heat treatment step is carried out at. In some embodiments, the second artificial aging heat treatment step may include temperatures and time that are less than or equal to conditions suitable for artificially aging an aluminum alloy having Magnesium and Zinc to peak hardness, i.e. peak aging.

As shown in FIG. 2, after quenching in step 216, or after an optional artificial aging in step 218, the aluminum alloy may be subjected to a first severe plastic deformation process, such as an ECAE process, in step 220. ECAE may include passing the aluminum alloy billet through an ECAE device in a particular shape, such as a billet having a square or circular cross section. In some embodiments, this first ECAE process may be carried out at temperatures below the homogenizing heat treatment but above the artificial aging temperature of the aluminum alloy. In some embodiments, this first ECAE process may be carried out at temperatures of from about 100° C. to about 400° C., or from about 150° C. to about 300° C., or from about 200° C. to about 250° C. In some embodiments, the first ECAE process may refine and homogenize the microstructure of the alloy and may provide a better, more uniform, distribution of solutes and microsegregations. In some embodiments, this first ECAE process may be performed on an aluminum alloy at temperatures higher than 300° C. Processing aluminum alloys at temperatures higher than about 300° C. may provide advantages for healing of cast defects and redistribution of precipitates, but may also lead to coarser grain sizes and may be more difficult to implement in processing conditions. In some embodiments, during the extrusion process, the aluminum alloy material being extruded and the extrusion die may be maintained at the temperature that the extrusion process is being performed at to ensure a consistent temperature throughout the aluminum alloy material. That is, the extrusion die may be heated to prevent the aluminum alloy material from cooling during the extrusion process. In some embodiments, the first ECAE process may include one, two or more, or four or more extrusion passes.

In some embodiments, after a first severe plastic deformation, the aluminum alloy may be subjected to a second solutionizing in step 222. The second solutionizing may be carried out on the aluminum alloy at similar temperature and time conditions as the first solutionizing. In some embodiments, the second solutionizing may be carried out at a temperature and/or duration that are different than the first solutionizing. In some embodiments, a suitable second solutionizing temperature may be from about 400° C. to about 550° C., from about 420° C. to about 500° C., or from about 450° C. to about 480° C. A second solutionizing may be carried out for a suitable duration based on the size, such as the cross sectional area, of the billet. For example, the second solutionizing may be carried out for from about 30 minutes to about 8 hours, from 1 hour to about 6 hours, or from about 2 hours to about 4 hours, depending on the cross section of the billet. In some embodiments, the second solutionizing may be from about 450° C. to about 480° C. for up to 8 hours. The second solutionizing may be followed by quenching.

In some embodiments, after the second solutionizing, the aluminum alloy may be subjected to a second severe plastic deformation step, such as an ECAE process, in step 226. In some embodiments, the second ECAE process may be carried out at lower temperatures than that used in the first ECAE process of step 220. For example, the second ECAE process may be carried out at temperatures greater than 0° C. and less than 160° C., or from about 20° C. to about 125° C., or from about 20° C. to about 100° C., or about room temperature, for example from about 20° C. to about 35° C. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the second ECAE process may include one pass, two or more passes, or four or more extrusion passes through the ECAE device.

In some embodiments, after the aluminum alloy is submitted to a second severe plastic deformation step such as ECAE, a second artificial aging process may be carried out in step 228. In some embodiments, artificial aging may be carried out in a single heat treatment step, or be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first aging step may be carried out at about 90° C. for about 8 hours and the second aging may be carried out at about 115° C. for about 40 hours or less. In some embodiments, the second step may include temperatures and time that are less than or equal to conditions suitable for artificially aging an aluminum alloy having Magnesium and Zinc to peak hardness, i.e. peak hardness.

Following method 200, the aluminum alloy may optionally undergo further plastic deformation, such as rolling to change the shape or size of the aluminum alloy.

Figure 3:
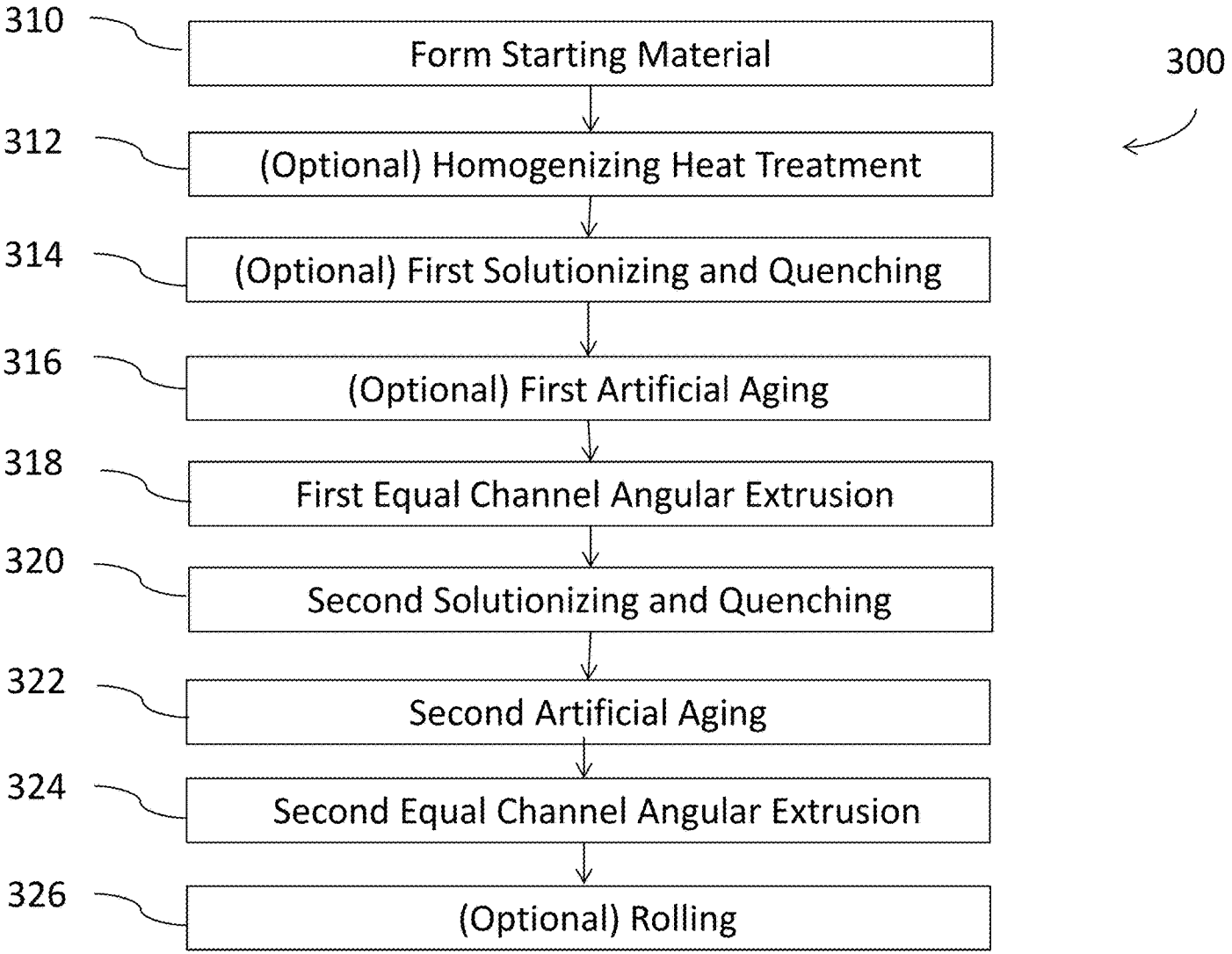
FIG. 3 is a flow chart showing an alternative embodiment of a method of forming a high-strength aluminum alloy.

A method 300 of forming a high strength aluminum alloy is shown in FIG. 3. The method 300 may include casting a starting material in step 310. For example, an aluminum material may be cast into a billet form. The aluminum material may include additives, such as other elements, which will alloy with the aluminum during method 310 to form an aluminum alloy. In some embodiments, the aluminum material billet may be formed using standard casting practices for an aluminum alloy having Magnesium and Zinc, such as aluminum-zinc alloys, for example A17000 series aluminum alloys.

After formation, the aluminum material billet may be subjected to an optional homogenizing heat treatment in step 312. The homogenizing heat treatment may be applied by holding the aluminum material billet at a suitable temperature above room temperature to improve the aluminum's hot workability in following steps. The homogenizing heat treatment may be specifically tailored to a specific aluminum alloy having Magnesium and Zinc, such as an aluminum-zinc alloy. In some embodiments, a suitable temperature for the homogenizing heat treatment may be from about 300° C. to about 500° C.

After the homogenizing heat treatment, the aluminum material billet may be subjected to an optional first solutionizing in step 314 to form an aluminum alloy. The first solutionizing may be similar to that described herein with respect to steps 114 and 214. A suitable first solutionizing temperature may be from about 400° C. to about 550° C., from about 420° C. to about 500° C., or from about 450° C. to about 480° C. A first solutionizing may be carried out for a suitable duration based on the size, such as the cross sectional area, of the billet. For example, the first solutionizing may be carried out for from about 30 minutes to about 8 hours, from 1 hour to about 6 hours, or from about 2 hours to about 4 hours, depending on the cross section of the billet. As an example, the solutionizing may be carried out at 450° C. to about 480° C. for up to 8 hours. The solutionizing may be followed by quenching. During quenching, the aluminum alloy billet is rapidly cooled by quenching the aluminum alloy billet is cooled to about room temperature or lower. This rapid cooling retains any elements dissolved into the aluminum alloy at a higher concentration than the equilibrium concentration of that element in the aluminum alloy at room temperature.

In some embodiments, after the aluminum alloy is quenched, artificial aging may optionally be carried out in step 316. In some embodiments, artificial aging may be carried out with two heat treatment steps that form the artificial aging step. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first step may be carried out at about 90° C. for about 8 hours and the second step may be carried out at about 115° C. for about 40 hours or less. Generally, a first artificial aging heat treatment step may be carried out at a lower temperature and for less time than the temperature and duration that the second artificial aging heat treatment step is carried out at. In some embodiments, the second artificial aging heat treatment step may include temperatures and time that are less than or equal to conditions suitable for artificially aging an aluminum alloy having Magnesium and Zinc to peak hardness, i.e. peak aging.

After artificial aging, the aluminum alloy billet may be subjected to severe plastic deformation, such as a first ECAE process, in step 318. For example, the aluminum alloy billet may be passed through an ECAE device to extrude the aluminum alloy as a billet having a square or circular cross section. In some embodiments, a first ECAE process may be carried out at elevated temperatures, for example, temperatures below the homogenizing heat treatment but above the artificial aging temperature of a particular aluminum-zinc alloy. In some embodiments, the first ECAE process may be carried out with the aluminum alloy maintained at temperatures from about 100° C. to about 400° C., or from about 200° C. to about 300° C. In some embodiments, the first ECAE process may be carried out with the aluminum alloy maintained at temperatures higher than 300° C. Temperatures at this level may provide certain advantages, such as healing of cast defects and redistribution of precipitates, but may also lead to coarser grain sizes and may be more difficult to implement in processing conditions. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the first ECAE process may include one pass, two or more passes, or four or more extrusion passes through the ECAE device.

In some embodiments, after severe plastic deformation, the aluminum alloy may be subjected to a second solutionizing in step 320. A suitable second solutionizing temperature may be from about 400° C. to about 550° C., from about 420° C. to about 500° C., or from about 450° C. to about 480° C. A second solutionizing may be carried out for a suitable duration based on the size, such as the cross sectional area, of the billet. For example, the second solutionizing may be carried out for from about 30 minutes to about 8 hours, from 1 hour to about 6 hours, or from about 2 hours to about 4 hours, depending on the cross section of the billet. In some embodiments, the second solutionizing may be from about 450° C. to about 480° C. for up to 8 hours. The second solutionizing may be followed by quenching.

In some embodiments, after the aluminum alloy is quenched after the second solutionizing, a second artificial aging process may be carried out in step 322. In some embodiments, artificial aging may be carried out in a single heat treatment step, or be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first aging step may be carried out at about 90° C. for about 8 hours and the second aging may be carried out at about 115° C. for about 40 hours or less. In some embodiments, the second step may include temperatures and time that are less than or equal to conditions suitable for artificially aging an aluminum alloy having Magnesium and Zinc to peak hardness, i.e. peak hardness.

In some embodiments, after the second artificial aging process, the aluminum alloy may be subjected to a second severe plastic deformation process, such as a second ECAE process, in step 324. In some embodiments, the second ECAE process may be carried out at lower temperatures than that used in the first ECAE process. For example, the second ECAE process may be carried out at temperatures greater than 0° C. and less than 160° C., or from about 20° C. to about 125° C., or about room temperature, for example from about 20° C. to about 35° C. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the second ECAE process may include one pass, two or more passes, or four or more extrusion passes through the ECAE device.

Following severe plastic deformation, the aluminum alloy may optionally undergo further plastic deformation in step 326, such as rolling, to change the shape or size of the aluminum alloy.

Figure 4:
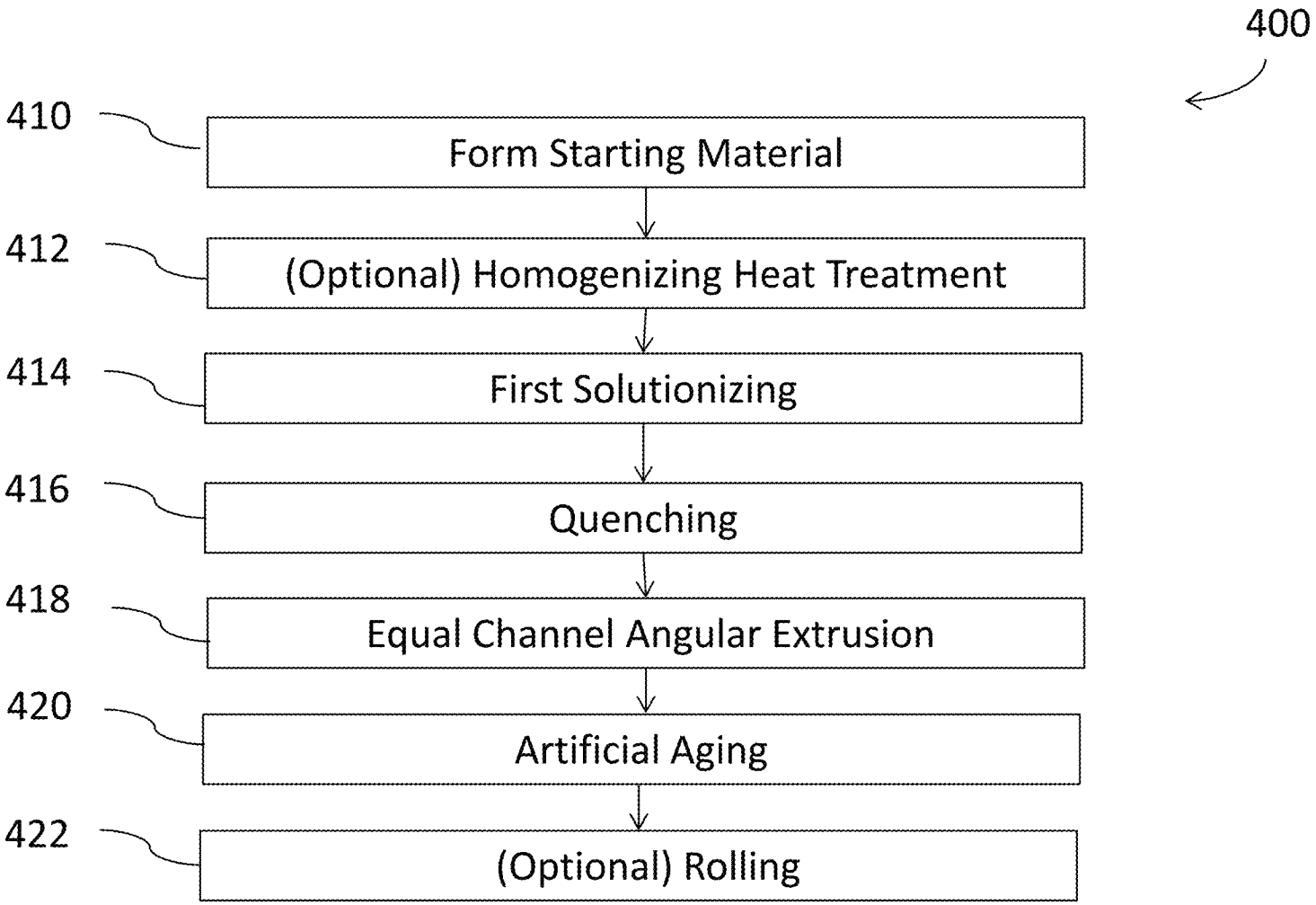
FIG. 4 is a flow chart showing an alternative embodiment of a method of forming a high-strength metal alloy.

A method of forming a high strength aluminum alloy is shown in FIG. 4. The method 400 includes forming a starting material in step 410. Step 410 may be the same or similar to steps 110 or 210 described herein with respect to FIGS. 1 and 2. In some embodiments, the starting material may be an aluminum material billet formed using standard casting practices for an aluminum material having Magnesium and Zinc. After the starting material is cast, a homogenizing heat treatment may optionally be employed in step 412. Step 412 may be the same or similar to steps 112 or 212 described herein with respect to FIGS. 1 and 2.

After the homogenizing heat treatment, the aluminum material may be subjected to a first solutionizing in step 414, to form an aluminum alloy. A suitable first solutionizing temperature may be from about 400° C. to about 550° C., from about 420° C. to about 500° C., or from about 450° C. to about 480° C. A first solutionizing may be carried out for a suitable duration based on the size, such as the cross sectional area, of the billet. For example, the first solutionizing may be carried out for from about 30 minutes to about 8 hours, from 1 hour to about 6 hours, or from about 2 hours to about 4 hours, depending on the cross section of the billet. As an example, the solutionizing may be carried out at 450° C. to about 480° C. for up to 8 hours. The solutionizing may be followed by quenching, as shown in step 416.

In some embodiments, after the solutionizing and quenching, the aluminum alloy billet may be subjected to a severe plastic deformation process in step 418. In some embodiments, the severe plastic deformation process may be ECAE. For example, the aluminum alloy billet may be passed through an ECAE device having a square or circular cross section. For example, an ECAE process may include one or more ECAE passes. In some embodiments, the ECAE process may be carried out with the aluminum alloy billet at temperatures greater than 0° C. and less than 160° C., or from about 20° C. to about 125° C., or about room temperature, for example from about 20° C. to about 35° C. In some embodiments, during the ECAE, the aluminum alloy billet being extruded and the extrusion die may be maintained at the temperature that the extrusion process is being carried out at to ensure a consistent temperature throughout the aluminum alloy billet. That is, the extrusion die may be heated to prevent the aluminum alloy from cooling during the extrusion process. In some embodiments, the ECAE process may include one pass, two or more passes, or four or more extrusion passes through the ECAE device.

In some embodiments, after the aluminum alloy is subjected to severe plastic deformation in step 418, artificial aging may be carried out in step 420. In some embodiments, artificial aging may be carried out in a single heat treatment step, or be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first aging step may be carried out at about 90° C. for about 8 hours and the second aging may be carried out at about 115° C. for about 40 hours or less. In some embodiments, the second step may include temperatures and time that are less than or equal to conditions suitable for artificially aging an aluminum alloy having Magnesium and Zinc to peak hardness, i.e. peak hardness.

Following artificial aging, the aluminum alloy may optionally undergo further plastic deformation in step 422, such as rolling, to change the shape or size of the aluminum alloy billet.

The methods shown in FIGS. 1 to 4 may be applied to aluminum alloys, such as an aluminum-zinc alloy, such as an aluminum alloy having Magnesium and Zinc. In some embodiments, the methods of FIGS. 1 to 4 may be applied to aluminum alloys that are suitable for use in portable electronic device cases due to high yield strength (i.e., a yield strength from 400 MPa to 650 MPa), a low weight density (i.e., about 2.8 g/cm$^3$), and relative ease of manufacturing to complex shapes.

In addition to the mechanical strength requirements there may also be a desire for the aluminum alloy to meet particular cosmetic appearance requirements, such as a color or shade. For example, in the portable electronics area, there may be a desire for an outer alloy case to have a specific color or shade without the use of paint or other coatings.

It has been found that copper-containing aluminum alloys often display a yellowish color after being anodized. In certain applications, this coloring is undesirable for various reasons such as marketing or cosmetic design. Certain aluminum-zinc alloys may thus make better candidates for certain applications because they contain zinc (Zinc) and magnesium (Magnesium) as the main elements, with Copper present in lower concentrations. To facilitate the desired coloring characteristics, the Copper level must be kept relatively low, preferably less than about 0.5 wt. %. The weight percentages and weight ratio of Zinc and Magnesium in the aluminum alloy may also be carefully controlled. For example, Zinc and Magnesium are responsible for the increase in strength by forming (ZnMg) precipitates such as $MgZn_2$ that increase the strength of the aluminum alloy by precipitation hardening. However having too much Zinc and Magnesium present decreases the resistance to stress corrosion during specific manufacturing steps such as anodizing. Therefore, a suitable aluminum alloy has a balanced composition with a specific weight ratio of Zinc to Magnesium, such as from about 3:1 to about 7:1. Additionally, the overall weight percentage of Magnesium and Zinc may be controlled. In most examples, Zinc may be present from about 4.25 wt. % to about 6.25 wt. % and Magnesium may be present from about 0.5 wt. % to about 2.0 wt. %.

As-cast yield strengths for aluminum alloys having the Zinc and Magnesium weight percentages listed above have been found to be around 350-380 MPa. Using the methods disclosed herein, it has been found possible to further increase the strength of aluminum alloys having Zinc and Magnesium and low concentrations of Copper, thus making the resulting alloy attractive for use in electronic device cases. For example, using the methods described with reference to FIGS. 1 to 4, yield strengths of 420 MPa to 500 MPa have been achieved with aluminum-zinc alloys having Zinc and Magnesium and low concentrations of Copper.

As described herein the mechanical properties of aluminum-zinc alloys can be improved by subjecting the alloy to severe plastic deformation (SPD). As used herein, severe plastic deformation includes extreme deformation of bulk pieces of material. In some embodiments, ECAE provides suitable levels of desired mechanical properties when applied to the materials described herein.

Figure 5:
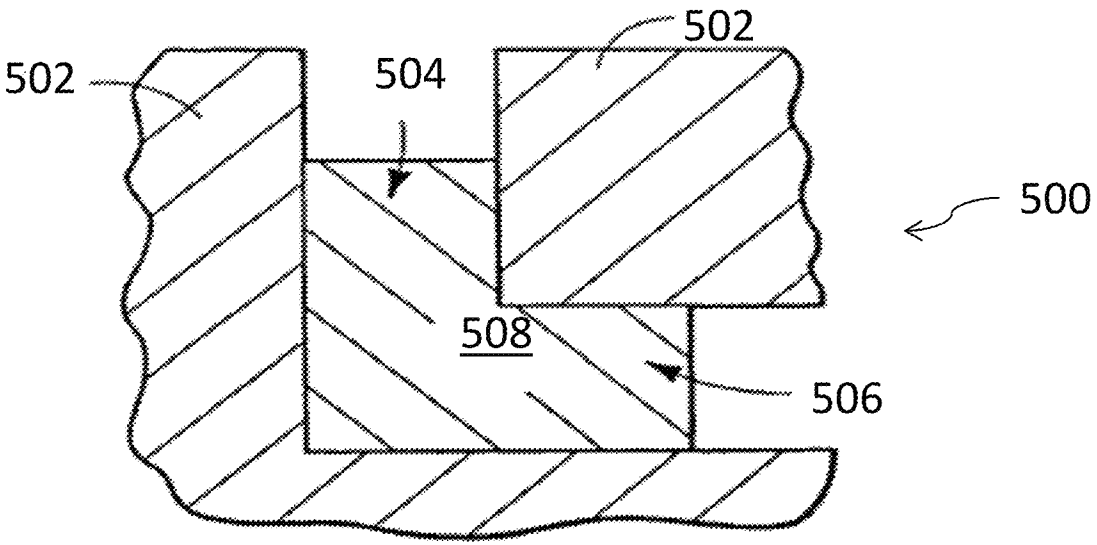
FIG. 5 is a schematic view of a sample equal channel angular extrusion device.

ECAE is an extrusion technique which consists of two channels of roughly equal cross-sections meeting at a certain angle comprised practically between 90° and 140°, preferably 90°. An example ECAE schematic of an ECAE device 500 is shown in FIG. 5. As shown in FIG. 5, an exemplary ECAE device 500 includes a mold assembly 502 that defines a pair of intersecting channels 504 and 506. The intersecting channels 504 and 506 are identical or at least substantially identical in cross-section, with the term "substantially identical" indicating the channels are identical within acceptable size tolerances of an ECAE apparatus. In operation, a material 508 is extruded through channels 504 and 506. Such extrusion results in plastic deformation of the material 508 by simple shear, layer after layer, in a thin zone located at the crossing plane of the channels. Although it can be preferable that channels 504 and 506 intersect at an angle of about 90°, it is to be understood that an alternative tool angle can be used (not shown). A tool angle of about 90° is typically used to produce optimal deformation, i.e. true shear strain. That is, using a tool angle of 90° true strain is 1.17 per each ECAE pass.

ECAE provides high deformation per pass, and multiple passes of ECAE can be used in combination to reach extreme levels of deformation without changing the shape and volume of the billet after each pass. Rotating or flipping the billet between passes allows various strain paths to be achieved. This allows control over the formation of the crystallographic texture of the alloy grains and the shape of various structural features such as grains, particles, phases, cast defects or precipitates. Grain refinement is enabled with ECAE by controlling three main factors: (i) simple shear, (ii)

intense deformation and (iii) taking advantage of the various strain paths that are possible using multiple passes of ECAE. ECAE provides a scalable method, a uniform final product, and the ability to form a monolithic piece of material as a final product.

Because ECAE is a scalable process, large billet sections and sizes can be processed via ECAE. ECAE also provides uniform deformation throughout the entire billet cross-section because the cross-section of the billet can be controlled during processing to prevent changes in the shape or size of the cross-section. Also, simple shear is active at the intersecting plane between the two channels.

ECAE involves no intermediate bonding or cutting of the material being deformed. Therefore, the billet does not have a bonded interface within the body of the material. That is, the produced material is a monolithic piece of material with no bonding lines or interfaces where two or more pieces of previously separate material have been joined together. Interfaces can be detrimental because they are a preferred location for oxidation, which is often detrimental. For example, bonding lines can be a source for cracking or delamination. Furthermore, bonding lines or interfaces are responsible for non-homogeneous grain size and precipitation and result in anisotropy of properties.

In some instances, the aluminum alloy billet may crack during ECAE. In certain aluminum alloys having Magnesium and Zinc, the high diffusion rate of Zinc in the aluminum alloy may affect processing results. In some embodiments, carrying out ECAE at increased temperatures may avoid cracking of the aluminum alloy billet during ECAE. For example, increasing the temperature that the aluminum alloy billet is held at during extrusion may improve the workability of the aluminum alloy and make the aluminum alloy billet easier to extrude. However, increasing the temperature of the aluminum alloy generally leads to undesirable grain growth, and in heat treatable aluminum alloys, higher temperatures may affect the size and distribution of precipitates. The altered precipitate size and distribution may have a deleterious effect on the strength of the aluminum alloy after processing. This may be the result when the temperature and time used during ECAE are above the temperature and time that correspond to peak hardness for the aluminum alloy being processed, i.e. above the temperature and time conditions that correspond to peak aging. Carrying out ECAE on an aluminum alloy with the alloy at a temperature too close to the peak aging temperature of the aluminum alloy may thus not be a suitable technique for increasing the final strength of certain aluminum alloys even though it may improve the billet surface conditions (i.e. reduce the number of defects produced).

Processing an aluminum alloy having Magnesium and Zinc via ECAE with the aluminum alloy held at about room temperature after an initial solutionizing and quenching may provide a suitable process for increasing the strength of the aluminum alloy. This technique may be fairly successful when a single ECAE pass is conducted almost immediately (i.e, within one hour) after the initial solutionizing and quenching treatments. However, this technique is not generally successful when multiple passes of ECAE are used, especially for aluminum alloys having Zinc and Magnesium in weight concentrations close to the upper level for the A17000 series (i.e., Zinc and Magnesium values of about 6.0 wt. % and 4.0 wt. % respectively). It has been found that for most aluminum alloys having Magnesium and Zinc, such as aluminum-zinc alloys, a single pass ECAE may not adequately increase the alloy strength or provide a sufficiently fine submicron structure.

In some embodiments, it may be beneficial to perform artificial aging on an aluminum-zinc alloy, such as an aluminum alloy having Magnesium and Zinc and a low concentration of Copper, before cold working the aluminum-zinc alloy if the aluminum-zinc alloy has been subjected to an initial solutionizing and quenching. This is because the effects of cold working an aluminum alloy having Magnesium and Zinc after solutionizing are the opposite of some other heat treatable aluminum alloys such as A12000 alloys. Cold work reduces the maximum attainable strength and toughness in overaged tempers of an aluminum alloy having Magnesium and Zinc, for example. The negative effect of cold work before artificial aging aluminum-zinc alloys is attributed to the nucleation of coarse precipitates on dislocations. The approach of using ECAE directly after solutionizing and quenching and before aging may therefore require particular parameters. This effect is shown further in the examples below.

Keeping the above considerations in mind, it has been found that particular processing parameters may improve the outcome of ECAE processes for aluminum alloys having Magnesium and Zinc, such as A17000 series alloys. These parameters are outlined further below.

Process Parameters for ECAE

Pre-ECAE Heat Treatment

It has been discovered that producing stable Guinier Preston (GP) zones and establishing thermally stable precipitates in an aluminum alloy before performing ECAE may improve workability which, for example, may lead to reduced billet cracking during ECAE. In some embodiments, this is accomplished by performing heat treatment such as artificial aging before carrying out ECAE. In some embodiments, artificial aging incorporates a two-step heat treatment which limits the effects of unstable precipitation at room temperature (also referred to as natural aging). Controlling precipitation is important for ECAE processing of aluminum alloys having Magnesium and Zinc alloys because these alloys have a fairly unstable sequence of precipitation, and high deformation during ECAE makes the alloy even more unstable unless the processing conditions and order of heat treatment are carefully controlled.

The effects of heat and time on precipitation in an aluminum alloy having Magnesium and Zinc have been evaluated. The sequence of precipitation in an aluminum alloy having Magnesium and Zinc is complex and dependent on temperature and time. First, using high temperature heat treatment such as solutionizing, solutes such as Magnesium and/or Zinc are put in solution by distributing throughout the aluminum alloy. The high temperature heat treatment is often followed by rapid cooling in water or oil, also known as quenching, to hold the solutes in solution. At relatively low temperatures for long time periods and during initial periods of artificial aging at moderately elevated temperatures, the principal change is a redistribution of solute atoms within the solid solution lattice to form clusters termed Guinier Preston (GP) zones that are considerably enriched in solute. This local segregation of solute atoms produces a distortion of the alloy lattice. The strengthening effect of the zones is a result of the additional interference with the motion of dislocations when they cut the GP zones. The progressive strength increase with aging time at room temperature (defined as natural aging) has been attributed to an increase in the size of the GP zones.

In most systems as aging time or temperature are increased, the GP zones are either converted into or replaced by particles having a crystal structure distinct from that of the solid solution and also different from the structure of the equilibrium phase. Those are referred as "transition" precipitates. In many alloys, these precipitates have a specific crystallographic orientation relationship with the solid solution, such that the two phases remain coherent on certain planes by adaptation of the matrix through local elastic strain. Strength continues to increase as the size and number of these "transition" precipitates increase, as long as the dislocations continue to cut the precipitates. Further progress of the precipitation reaction produces growth of "transition" phase particles, with an accompanying increase in coherency strains until the strength of interfacial bond is exceeded and coherency disappears. This usually coincides with the change in the structure of the precipitate from "transition" to "equilibrium" form and corresponds to peak aging, which is the optimum condition to obtain maximum strength. With loss of coherency, strengthening effects are caused by the stress required to cause dislocations to loop around rather than to cut precipitates. Strength progressively decreases with growth of equilibrium phase particles and an increase in inter-particle spacing. This last phase corresponds to overaging and in some embodiments is not suitable when the main goal is to achieve maximum strength.

In an aluminum alloy having Magnesium and Zinc, the GP zones are very small in size (i.e. less than 10 nm) and quite unstable at room temperature. As shown in the examples provided herein, a high level of hardening occurs after the alloy has been held at room temperature for a few hours after quenching, a phenomenon called natural aging. One reason for this hardening in an aluminum alloy having Magnesium and Zinc is the fast diffusion rate of Zinc, which is the element with the highest diffusion rate in aluminum. Another factor is the presence of Magnesium which strongly influences the retention of a high concentration of non-equilibrium vacancies after quenching. Magnesium has a large atomic diameter that makes the formation of magnesium-vacancy complexes and their retention during quenching easier. These vacancies are available for Zinc to diffuse into and form GP zones around the Magnesium atoms. Extended aging time and temperatures above room temperature (i.e. artificial aging) transform the GP zones into the transition precipitate called η' or M', the precursor of the equilibrium $MgZn_2$ phases termed η or M. For aluminum alloys having a higher Magnesium content (e.g. greater than 2.0 wt. %), the precipitation sequence includes the GP zone transforming into a transition precipitate called T' that becomes the equilibrium $Mg_3Zn_3Al_2$ precipitate called T at extended aging time and temperature. The precipitation sequence in A17000 can be summarized in the flow schematic shown in FIG. 6.

Figure 6:
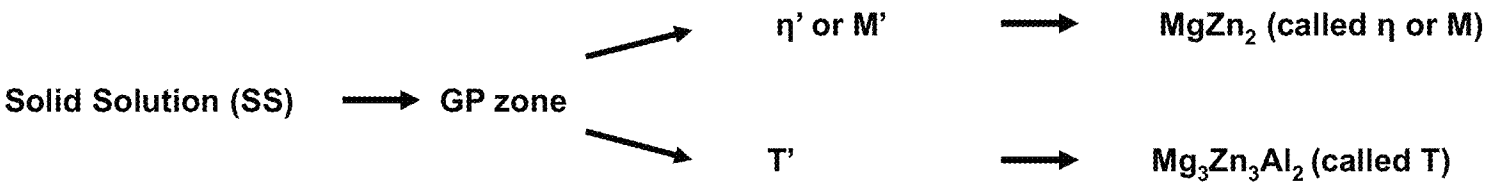
FIG. 6 is a schematic of a flow path of an example material change in an aluminum alloy undergoing heat treatment.

As shown in the flow schematic in FIG. 6, the GP zone nucleates homogeneously within the lattice and the various precipitates develop sequentially. However, the presence of grain boundaries, subgrain boundaries, dislocations and lattice distortions alters the free energy of zone and precipitate formation and significant heterogeneous nucleation may occur. This has two consequences in an aluminum alloy having Magnesium and Zinc. First, there is the potential for creating a non-homogeneous distribution of GP zones and precipitates, either of which may become a source for defects during cold or hot working. Second, heterogeneously nucleated precipitates at boundaries or dislocations are usually larger and do not contribute as much to the overall strength and therefore potentially decrease the maximum attainable strength. These effects may be enhanced when extreme levels of plastic deformation are introduced, for example during ECAE, directly after the solutionizing and quenching steps for at least the following reasons.

First, ECAE introduces a high level of subgrain, grain boundaries and dislocations that may enhance heterogeneous nucleation and precipitation and therefore lead to a non-homogenous distribution of precipitates. Second, GP zones or precipitates may decorate dislocations and inhibit their movement which leads to a reduction in local ductility. Third, even at room temperature processing, there is some level of adiabatic heating occurring during ECAE that provides energy for faster nucleation and precipitation. These interactions may happen dynamically during each ECAE pass. This leads to potentially detrimental consequences for the processing of a solutionized and quenched aluminum alloy having Magnesium and Zinc during ECAE.

Some of the potentially detrimental consequences are as follows. A propensity for surface cracking of the billet due to a loss in local ductility and heterogeneous precipitate distribution. This effect is most severe at the top billet surface. Limitation of the number of ECAE passes that can be used. As the number of passes increases the effects become more severe and cracking becomes more likely. A decrease in the maximum achievable strength during ECAE, partly due to heterogeneous nucleation effects and partly due to limitation of the number of ECAE passes, which affects the ultimate level of grain size refinement. An additional complication arises with the processing of solutionized and quenched aluminum-zinc alloys, such as A17000 series alloys, due to the fast kinetics of precipitation even at room temperature (i.e. during natural aging). It has been found that the time between the solutionizing and quenching steps and ECAE may be important to control. In some embodiments, ECAE may be conducted relatively soon after the quenching step, for example, within one hour.

Stable precipitates may be defined as precipitates that are thermally stable in an aluminum alloy even when the aluminum alloy is at a temperature and time that is substantially close to artificial peak aging for its given composition. In particular, stable precipitates are precipitates that will not change during natural aging at room temperature. Note that these precipitates are not GP zones but instead include transition and/or equilibrium precipitates (e.g. η' or M' or T' for aluminum-zinc alloys). The goal of heating (i.e. artificial aging) is to eliminate most of the unstable GP zones, which may lead to billet cracking during ECAE, and replace these with stable precipitates, which may be stable transition and equilibrium precipitates. It may also be suitable to avoid heating the aluminum alloy to conditions that are above peak aging (i.e. overaging conditions), which may produce mostly equilibrium precipitates that have grown and become too large, which may decrease the aluminum alloy final strength.

These limitations may be avoided by transforming most of the unstable GP zones into stable transition and/or equilibrium precipitates before performing the first ECAE pass. This may be accomplished, for example, by conducting a low temperature heat treatment (artificial aging) after or immediately after the solutionizing and quenching step, but before the ECAE process. In some embodiments, this may lead to most of the precipitation sequence occurring homogenously, contributing to a higher attainable strength and better stability of precipitates for ECAE processing. Furthermore, the heat treatment may consist of a two-step procedure that includes a first step that includes holding the material at a low temperature of 80° C. to 100° C. for less than or about 40 hours, and a second step that includes holding the material at a temperature and time that are less or equal than the peak aging conditions for the given an aluminum alloy having Magnesium and Zinc, for example holding the material between 100° C. and 150° C. for about 80 hours or less. The first low temperature heat treatment step provides a distribution of GP zones that is stable when the temperature is raised during the second heat treatment step. The second heat treatment step achieved the desired final distribution of stable transition and equilibrium precipitates.

In some embodiments, it may be advantageous to increase the uniformity and achieve a predetermined grain size of the alloy microstructure before conducting the final ECAE process at low temperature. In some embodiments, this may improve the mechanical properties and workability of the alloy material during ECAE as demonstrated by a reduced amount of cracking.

Aluminum alloys having Magnesium and Zinc are characterized by heterogeneous microstructures with large grain sizes and a large amount of macro and micro segregations. For example, the initial cast microstructure may have a dendritic structure with solute content increasing progressively from center to edge with an interdendritic distribution of second phase particles or eutectic phases. Certain homogenizing heat treatments may be performed before the solutionizing and quenching steps in order to improve structural uniformity and subsequent workability of billets. Cold working (such as stretching) or hot working is also often used to provide a specific billet shape or to stress relief or straighten the product. For plate applications such as forming a phone case, rolling may be used and may lead to anisotropy of the microstructure and properties in the final product even after heat treatments such as solutionizing, quenching and peak aging. Typically, grains are elongated along the rolling direction but are flattened along the thickness as well as the direction transverse to the rolling direction. This anisotropy is also reflected in the precipitate distribution, particularly along the grain boundaries.

In some embodiments, the microstructure of an aluminum alloy having Magnesium and Zinc with any temper, such as for example T651 may be broken down, refined, and made more uniform by applying a processing sequence that includes at least a single ECAE pass at elevated temperatures, such as below 450° C. This step is may be followed by solutionizing and quenching. In another embodiment, a billet made of the aluminum alloy having Magnesium and Zinc may be subjected to a first solutionizing and quenching step, followed by a single pass or multi-pass ECAE at moderately elevated temperatures between 150° C. and 250° C., followed by a second solutionizing and quenching step. After either of the above mentioned thermo-mechanical routes, the aluminum alloy can be further subjected to ECAE at a low temperature, either before or after artificial aging. In particular, it has been discovered that the initial ECAE process at elevated temperatures helps reduce cracking during a subsequent ECAE process at low temperatures of a solutionized and quenched aluminum alloy having Magnesium and Zinc. This result is described further in the examples below.

In some embodiments, ECAE may be used to impart severe plastic deformation and increase the strength of aluminum-zinc alloys. In some embodiments, ECAE may be performed after solutionizing, quenching and artificial aging is carried out. As described above, an initial ECAE process carried out while the material is at an elevated temperature may create a finer, more uniform and more isotropic initial microstructure before the second or final ECAE process at low temperature.

There are two main mechanisms for strengthening with ECAE. The first is refinement of structural units, such as the material cells, sub-grains and grains at the submicron or nanograined levels. This is also referred as grain size or Hall Petch strengthening and can be quantified using Equation 1.

$$\sigma_y = \sigma_o + \frac{k_y}{\sqrt{d}} \qquad \text{Equation 1}$$

Where $\sigma_y$ is the yield stress, $\sigma_o$ is a material constant for the starting stress or dislocation movement (or the resistance of the lattice to dislocation motion), $k_y$ is the strengthening coefficient (a constant that is specific to each material), and d is the average grain diameter. Based on this equation, strengthening becomes particularly effective when d is less than 1 micron. The second mechanism for strengthening with ECAE is dislocation hardening, which is the multiplication of dislocations within the cells, subgrains, or grains of the material due to high straining during the ECAE process. These two strengthening mechanisms are activated by ECAE and it has been discovered that certain ECAE parameters can be controlled to produce particular final strengths in the aluminum alloy, particularly when extruding aluminum-zinc alloys that have previously been subjected to solutionizing and quenching.

First, the temperatures and time used for ECAE may be less than those corresponding to the conditions of peak aging for the given aluminum alloy having Magnesium and Zinc. This involves controlling both the die temperature during ECAE and potentially employing an intermediate heat treatment in between each ECAE pass, when an ECAE process including multiple passes is performed, to maintain the material being extruded at a desired temperature. For example, the material being extruded may be kept maintained at a temperature of about 160° C. for about 2 hours between each extrusion pass. In some embodiments, the material being extruded may be kept maintained at temperature of about 120° C. for about 2 hours in between each extrusion pass.

Second, in some embodiments, it may be advantageous to maintain the temperature of the material being extruded at as low a temperature as possible during ECAE to get the highest strength. For example, the material being extruded may be maintained at about room temperature. This may result in an increased number of dislocations formed and produce a more efficient grain refinement.

Third, it may be advantageous to perform multiple ECAE passes. For example, in some embodiments, two or more passes may be used during an ECAE process. In some embodiments, three or more, or four or more passes may be used. In some embodiments, a high number of ECAE passes provides a more uniform and refined microstructure with more equiaxed high angle boundaries and dislocations that result in superior strength and ductility of the extruded material.

In some embodiments, ECAE affects the grain refinement and precipitation in at least the following ways. In some embodiments, ECAE has been found to produce faster precipitation during extrusion, due to the increased volume of grain boundaries and higher mechanical energy stored in sub-micron ECAE processed materials. Additionally, diffusion processes associated with precipitate nucleation and growth are enhanced. This means that some of the remaining GP zones or transition precipitates can be transformed dynamically into equilibrium precipitates during ECAE. In some embodiments, ECAE has been found to produce more uniform and finer precipitates. For example, a more uniform distribution of very fine precipitates can be achieved in ECAE submicron structures because of the high angle boundaries. Precipitates can contribute to the final strength of the aluminum alloy by decorating and pinning dislocations and grain boundaries. Finer and more uniform precipitates may lead to an overall increase in the extruded aluminum alloy final strength.

There are additional parameters of the ECAE process that may be controlled to further increase success. For example, the extrusion speed may be controlled to avoid forming cracks in the material being extruded. Second, suitable die designs and billet shapes can also assist in reducing crack formation in the material.

In some embodiments, additional rolling and/or forging may be used after the aluminum alloy has undergone ECAE to get the aluminum alloy closer to the final billet shape before machining the aluminum alloy into its final production shape. In some embodiments, the additional rolling or forging steps can add further strength by introducing more dislocations in the micro-structure of the alloy material.

In the examples described below, Brinell hardness was used as an initial test to evaluate the mechanical properties of aluminum alloys. For the examples included below, a Brinell hardness tester (available from Instron®, located in Norwood, Mass.) was used. The tester applies a predetermined load (500 kgf) to a carbide ball of fixed diameter (10 mm), which is held for a predetermined period of time (10-15 seconds) per procedure, as described in ASTM E10 standard. Measuring Brinell hardness is a relatively straightforward testing method and is faster than tensile testing. It can be used to form an initial evaluation for identifying suitable materials that can then be separated for further testing. The hardness of a material is its resistance to surface indentation under standard test conditions. It is a measure of the material's resistance to localized plastic deformation. Pressing a hardness indentor into the material involves plastic deformation (movement) of the material at the location where the indentor is impressed. The plastic deformation of the material is a result of the amount of force applied to the indentor exceeding the strength of the material being tested. Therefore, the less the material is plastically deformed under the hardness test indentor, the higher the strength of the material. At the same time, less plastic deformation results in a shallower hardness impression; so the resultant hardness number is higher. This provides an overall relationship, where the higher a material's hardness, the higher the expected strength. That is, both hardness and yield strength are indicators of a metal's resistance to plastic deformation. Consequently, they are roughly proportional.

Tensile strength is usually characterized by two parameters: yield strength (YS) and ultimate tensile strength (UTS). Ultimate tensile strength is the maximum measured strength during a tensile test and it occurs at a well-defined point. Yield strength is the amount of stress at which plastic deformation becomes noticeable and significant under tensile testing. Because there is usually no definite point on an engineering stress-strain curve where elastic strain ends and plastic strain begins, the yield strength is chosen to be that strength where a definite amount of plastic strain has occurred. For general engineering structural design, the yield strength is chosen when 0.2% plastic strain has taken place. The 0.2% yield strength or the 0.2% offset yield strength is calculated at 0.2% offset from the original cross-sectional area of the sample. The equation that may be used is $s=P/A$, where s is the yield stress or yield strength, P is the load and A is the area over which the load is applied.

Figure 7:
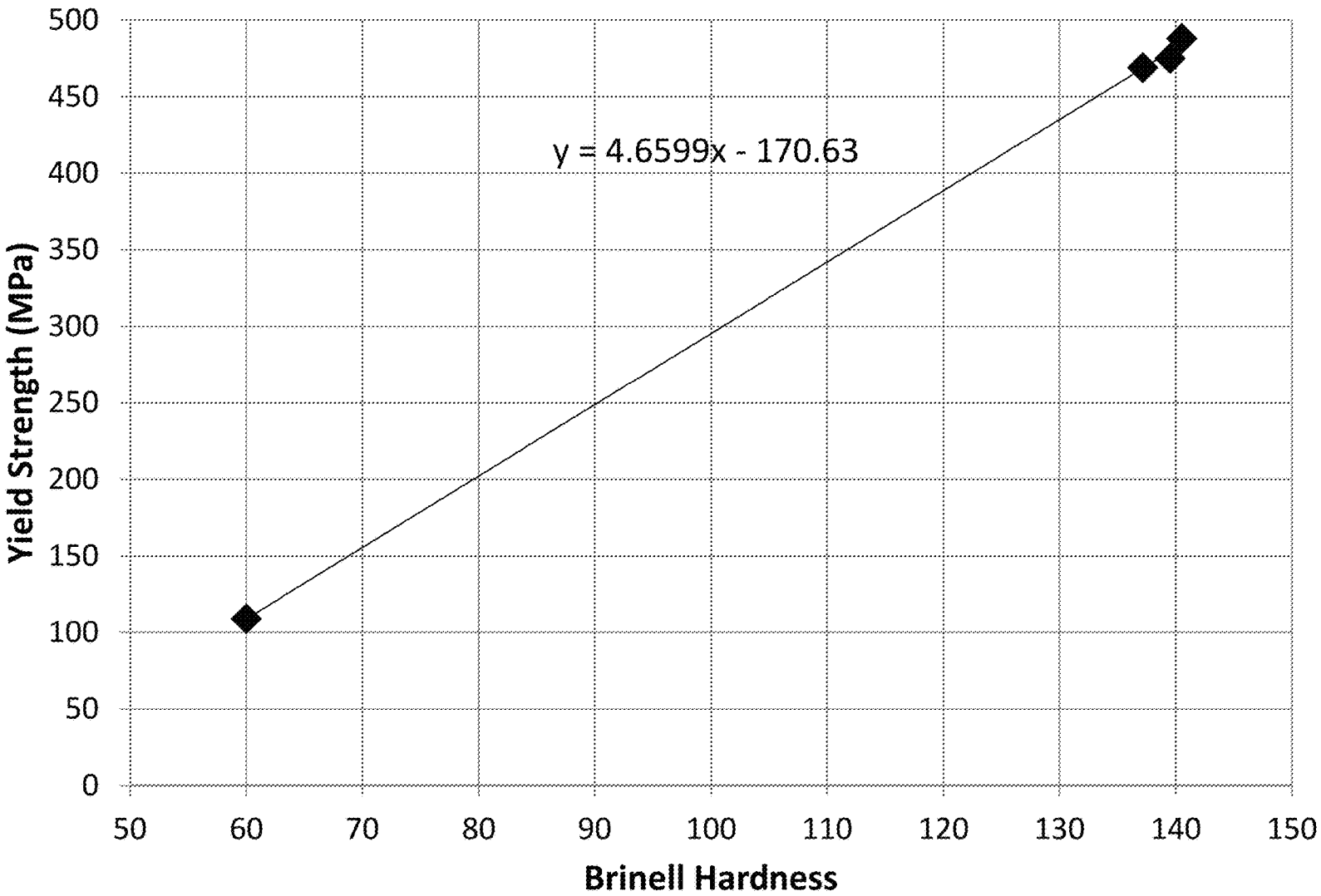
FIG. 7 is a graph comparing Brinell hardness to yield strength in an aluminum alloy.

Note that yield strength is more sensitive than ultimate tensile strength due to other microstructural factors such as grain and phase size and distribution. However, it is possible to measure and empirically chart the relationship between yield strength and Brinell hardness for specific materials, and then use the resulting chart to provide an initial evaluation of the results of a method. Such a relationship was evaluated for the materials and examples below. The data was graphed and the results are shown in FIG. 7. As shown in FIG. 7, it was determined that for the materials evaluated, a Brinell hardness above about 111 HB corresponds to YS above 350 MPa and a Brinell hardness above about 122 HB corresponds to YS above 400 MPa.

EXAMPLES

The following non-limiting examples illustrate various features and characteristics of the present invention, which is not to be construed as limited thereto.

Example 1: Natural Aging in an Aluminum Alloy Having Magnesium and Zinc

The effect of natural aging was evaluated in an aluminum alloy having aluminum as a primary component and Magnesium and Zinc as secondary components. For this initial assay, A17020 was chosen because of its low Copper weight percentage and the Zinc to Magnesium ratio from about 3:1 to 4:1. As discussed above, these factors affect the cosmetic appearance for applications such as device casings. The composition of the sample alloy is displayed in Table 1 with a balance of aluminum. It should be noted that Zinc (at 4.8 wt. %) and Magnesium (at 1.3 wt. %) are the two alloying elements present in the highest concentrations and the Copper content is low (at 0.13 wt. %).

TABLE 1

Composition of A17020 Starting Material (Weight Percentage)

| Si | Fe | Copper | Mn | Magnesium | Cr | Zinc | Zr | Ti + Zr | Ag |
|---|---|---|---|---|---|---|---|---|---|
| 0.1 | 0.28 | 0.13 | 0.25 | 1.3 | 0.12 | 4.8 | 0.13 | 0.16 | 0 |

Figure 8:
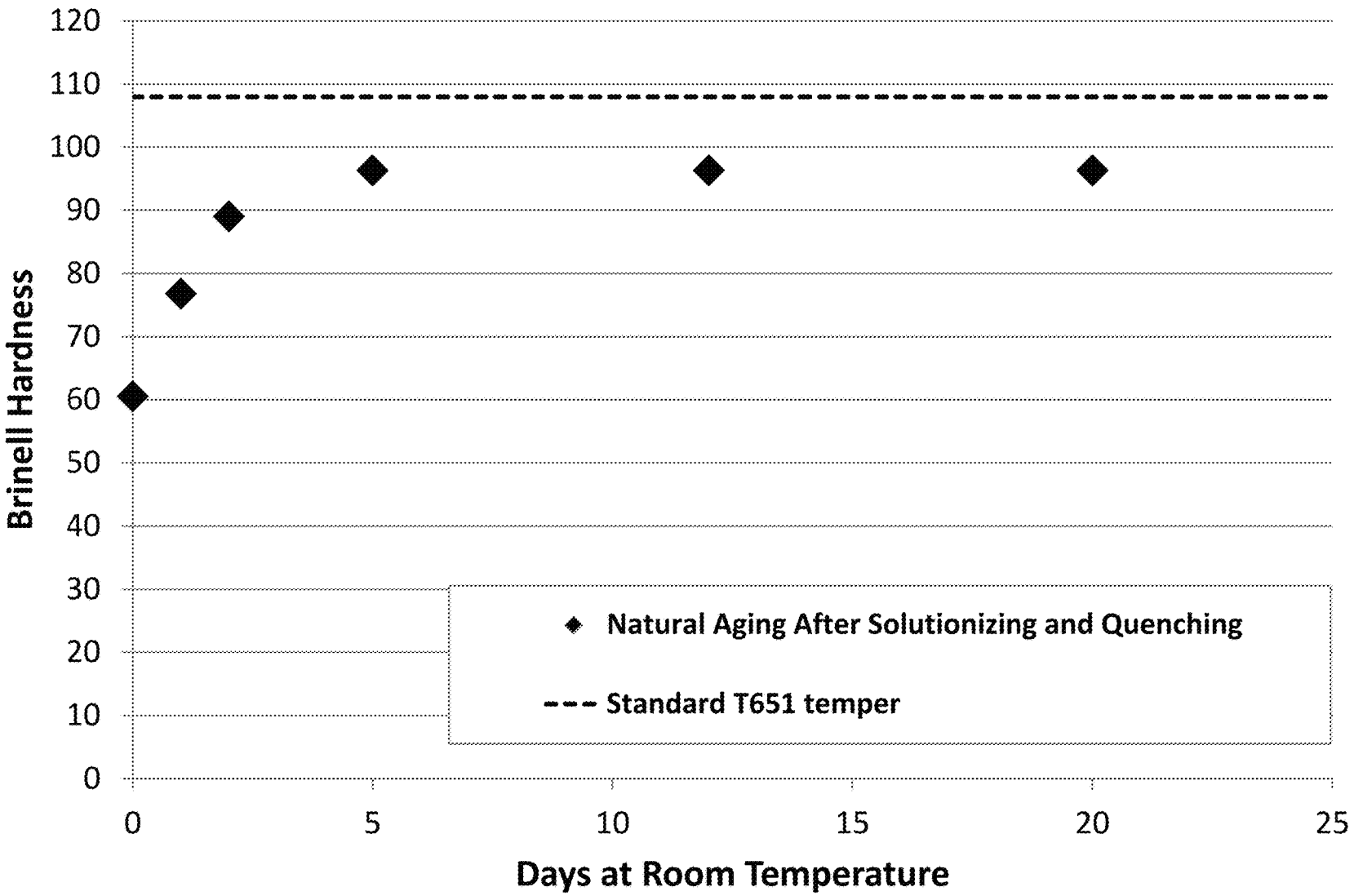
FIG. 8 is a graph comparing natural aging time to Brinell hardness in an aluminum alloy.

The as-received A17020 material was subjected to a solutionizing heat treatment by holding the material at 450° C. for two hours and then was quenched in cold water. The sample material was then kept at room temperature (25° C.) for several days. The Brinell hardness was used to evaluate the stability of the mechanical properties of the sample material after being stored at room temperature for a number of days (so called natural aging). The hardness data is presented in FIG. 8. As shown in FIG. 8, after only one day at room temperature there was already a substantial increase in hardness from 60.5 HB to about 76.8 HB; about a 30% increase. After about 5 days at room temperature, the hardness reached 96.3 HB and remained fairly stable, showing minimal changes when measured over 20 days. The rate of increase in hardness indicates an unstable supersaturated solution and precipitation sequence for A17020. This unstable supersaturated solution and precipitation sequence is characteristic of many A17000 series alloys.

Example 2: Example of Anisotropy of Microstructure in the Initial Alloy Material The aluminum alloy formed in Example 1 was subjected to hot rolling to form the alloy material into a billet followed by thermo-mechanical processing to the T651 temper that includes solutionizing, quenching, stress relief by stretching to an increase of 2.2% greater than the starting length and artificial peak aging. The measured mechanical properties of the resulting material are listed in Table 2. The yield strength, ultimate tensile strength and Brinell hardness of the A17020 material are 347.8 MPa, 396.5 MPa and 108 HB respectively. The tensile testing was conducted with the example material at room temperature using round tension bars with threaded ends. The diameter of the tension bars were 0.250 inch and the gage was length 1.000 inch. The geometry of round tension test specimens is described in ASTM Standard E8.

TABLE 2

Mechanical Properties of Al7020 Material in Example 2

| Temper | YS (MPa) | UTS (MPa) | Percent Elongation (%) | Hardness (HB) |
|---|---|---|---|---|
| T651 | 347.8 | 396.5 | 14.4 | 108 |

Figure 9:
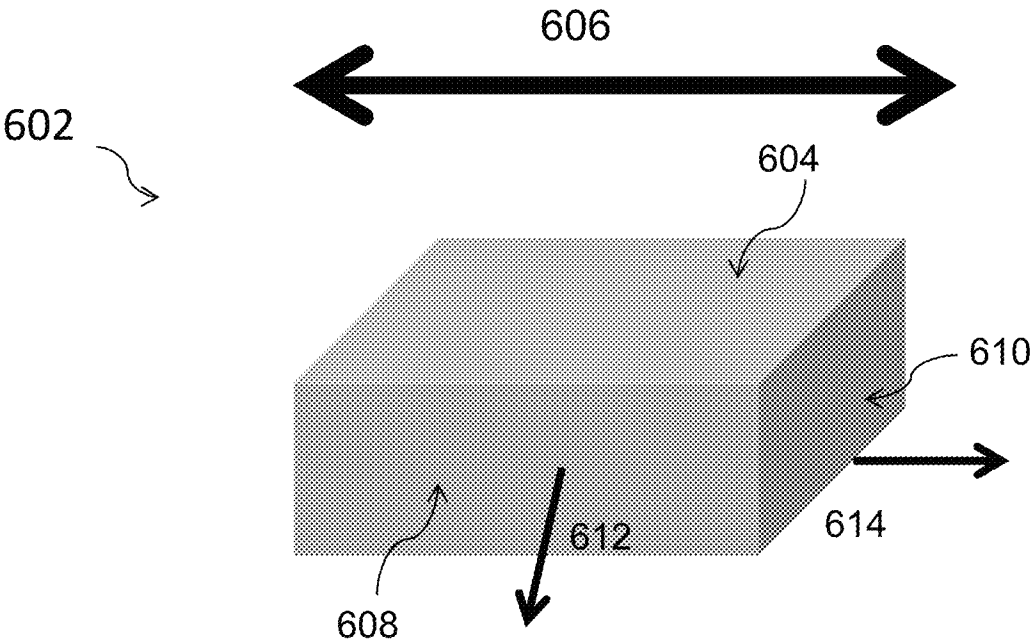
FIG. 9 is a schematic illustrated various orientations of a sample material prepared for thermomechanical processing.
Figure 10A:
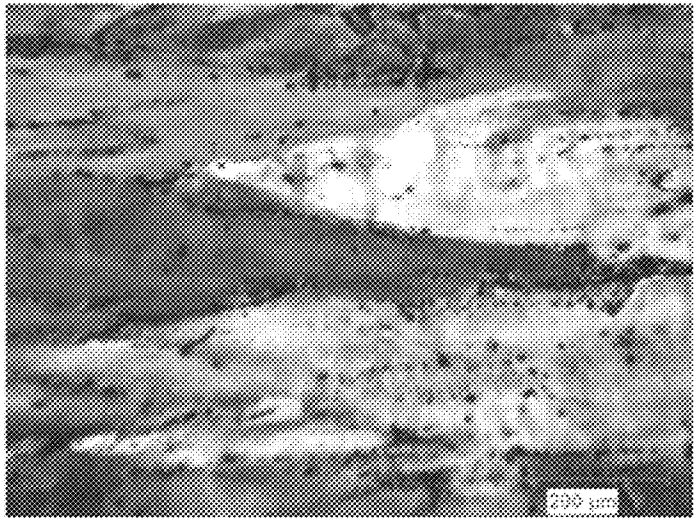
FIGS. 10A to 10C are optical microscopy images of an aluminum alloy that has been processed using exemplary methods disclosed herein.
Figure 10B:
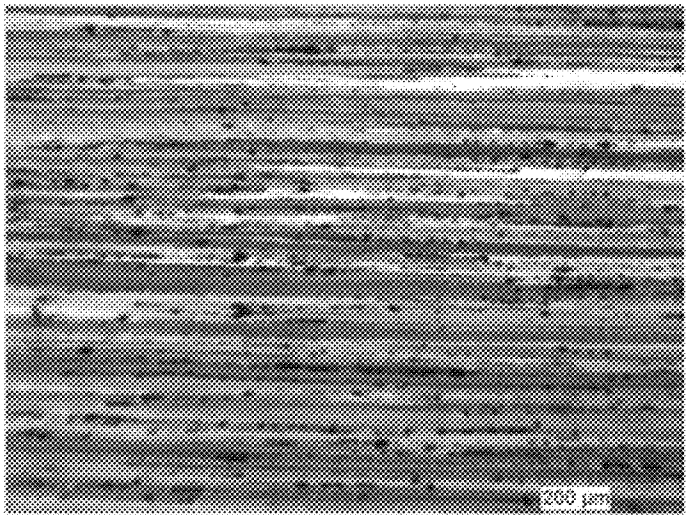
Figure 10C:
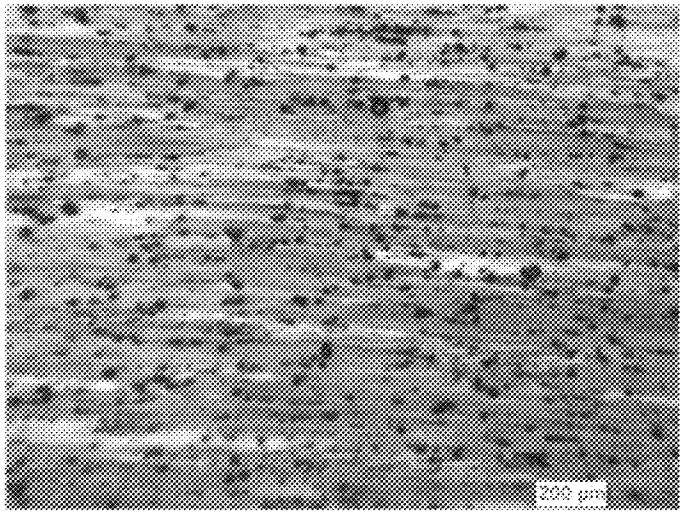

FIG. 9 illustrates the planes of an example billet 602 to show the orientation of a top face 604 of the billet 602. The arrow 606 shows the direction of rolling and stretching. The first side face 608 is in the plane parallel to the rolling direction and perpendicular to the top face 604. The second side face 610 is in the plane perpendicular to the rolling direction of arrow 606 and the top face 604. Arrow 612 shows the direction normal to the plane of the first side face, and arrow 614 shows the direction normal to the plane of the second side face 610. An optical microscopy image of the grain structure of the A17020 material from Example 2 is shown in FIGS. 10A to 10C. FIGS. 10A to 10C show the microstructure of A17020 with a T651 temper across the three planes shown in FIG. 9. Optical microscopy was used for grain size analysis. FIG. 10A is an optical microscopy image of the top face 604 shown in FIG. 9 at ×100 magnification. FIG. 10B is an optical microscopy image of the first side face 608 shown in FIG. 9 at ×100 magnification. FIG. 10C is an optical microscopy image of the second side face 610 shown in FIG. 9 at ×100 magnification.

As shown in FIGS. 10A to 10C, an anisotropic fibrous microstructure consisting of elongated grains is detected. The original grains are compressed through the billet thickness, which is the direction normal to the rolling direction, and elongated along the rolling direction during thermo-mechanical processing. The grain sizes as measured across the top face are large and non-uniform around 400 to 600 μm in diameter with a large aspect ratio of average grain length to thickness ranging between 7:1 to 10:1. The grain boundaries are difficult to resolve along the two other faces shown in FIGS. 10B and 10C, but clearly demonstrate heavy elongation and compression as exemplified by thin parallel bands. This type of large and non-uniform microstructure is characteristic in aluminum alloys having Magnesium and Zinc and having a standard temper such as T651.

Example 3: ECAE of as Solutionized and Quenched A17020 Material

A billet of A17020 material with the same composition and T651 temper as in Example 2 was subjected to solutionizing at a temperature of 450° C. for 2 hours and immediately quenched in cold water. This process was carried out to retain the maximum number of elements added as solutes, such as Zinc and Magnesium, in solid solution in the aluminum material matrix. It is believed that this step also dissolved the (ZnMg) precipitates present in the aluminum material back into the solid solution. The resulting microstructure of the A17020 material was very similar to the one described in Example 2 for aluminum material that had the temper T651, and consisted of large elongated grains parallel to the initial rolling direction. The only difference is the absence of fine soluble precipitates. The soluble precipitates are not visible by optical microscopy because they are below the resolution limit of 1 micron; only the large (i.e. greater than 1 micron in diameter) non soluble precipitates are visible. Thus, the results of Example 3 illustrate that the after solutionizing and quenching steps the grain size and anisotropy of the initial T651 microstructure remained unchanged.

Figure 11:
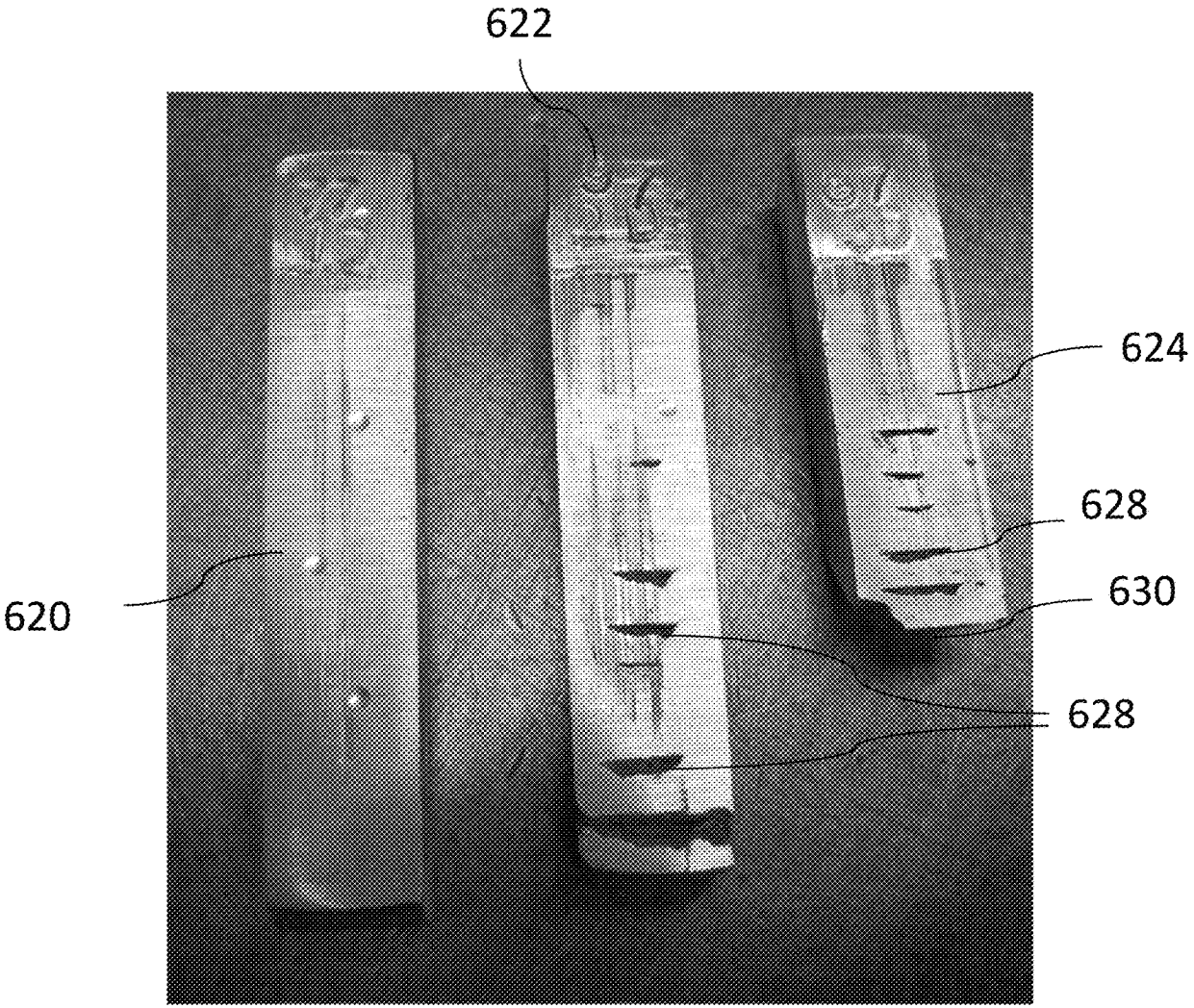
FIG. 11 is an image of an aluminum alloy that has been processed using exemplary methods disclosed herein.

The A17020 material was then shaped into three billets, i.e. bars, with a square cross-section and a length that is greater than the cross-section, and ECAE was then performed on the billets. The first pass was performed within 30 minutes after the solutionizing and quenching to minimize the effect of natural aging. Furthermore, ECAE was conducted at room temperature to limit the temperature effects on precipitation. FIG. 11 shows a photograph of a first billet 620 of A17020 after having undergone one pass, a second billet 622 having undergone two passes, and a third billet 624 having undergone three passes. The ECAE process was successful for the first billet 620 after one pass. That is, as shown in FIG. 11, the billet did not crack after one ECAE pass. However, heavy localized cracking at the top face of the billet occurred in the second billet 622 that was subjected to two passes. FIG. 11 shows the cracks 628 in the second billet 622 that developed after two passes. As also shown in FIG. 11, the third billet 624, which was subjected to three passes, also exhibited cracks 628. As shown in FIG. 11, the cracks intensified to such an extent that one macro-crack 630 ran through the entire thickness of the third billet 624 and split the billet into two pieces.

The three sample billets were further submitted to a two-step peak aging treatment consisting of a first heat treatment step with the samples held at 90° C. for 8 hours followed by a second heat treatment step with the samples held at 115° C. for 40 hours. Table 3 displays Brinell hardness data as well as tensile data for the first billet 620. The second billet 622 and the third billet 624 had too deep of cracking and the machine tensile test could not be conducted for these samples. All measurements were conducted with the sample material at room temperature.

TABLE 3

Test Results After Various Numbers of ECAE Passes and aging treatment

| Sample | Number of ECAE passes | Brinell Hardness (HB) | YS (MPa) | UTS (MPa) | Surface condition |
|---|---|---|---|---|---|
| Billet 620 | 1 | 127 | 382 | 404 | good |
| Billet 622 | 2 | 132 | n/a | n/a | crack at top |
| Billet 624 | 3 | 138 | n/a | n/a | crack through sample |

As shown in Table 3, a steady increase in hardness from about 127 to 138 was recorded with increasing number of ECAE passes. This increase is higher than the hardness value for material having only the T651 temper condition, as shown in Example 2. Yield strength data for the first sample after one pass also shows increased hardness when compared to material having only the T651 temper. That is, the yield strength increased to 382 MPa from 347.8 MPa.

This example demonstrates the ability of ECAE to improve strength in aluminum-zinc alloys as well as certain limitations due to billet cracking during ECAE processing. The next examples illustrate techniques to improve the overall processing during ECAE at a low temperature and, as a result, enhance the material strength without cracking the material.

Example 4: Multi-Step ECAE of As-Solutionized and Quenched Samples—Effect of Initial Grain Size and Anisotropy To evaluate the potential effect of the initial microstructure on the processing results, A17020 material with the T651 temper of Examples 1 and 2 was submitted to a more complex thermo-mechanical processing route than in Example 3. In this Example, ECAE was performed in two steps, one before and one after a solutionizing and quenching step with each step including an ECAE cycle having multiple passes. The first ECAE cycle was aimed at refining and homogenizing the microstructure before and after the solutionizing and quenching step, whereas the second ECAE cycle was conducted at a low temperature to improve the final strength as in Example 3.

The following process parameters were used for the first ECAE cycle. Four ECAE passes were used, with a 90 degree rotation of the billet between each pass to improve the uniformity of deformation and as a result the uniformity of microstructure. This is accomplished by activating simple shear along a three dimensional network of active shear planes during multi-pass ECAE. The A17020 material that formed the billet was maintained at a processing temperature of 175° C. throughout the ECAE. This temperature was chosen because it is low enough to give submicron grains after ECAE, but is above the peak aging temperature and therefore provides an overall lower strength and higher ductility, which is favorable for the ECAE process. The A17020 material billets did not suffer any cracking during this first ECAE cycle.

Figure 12B:
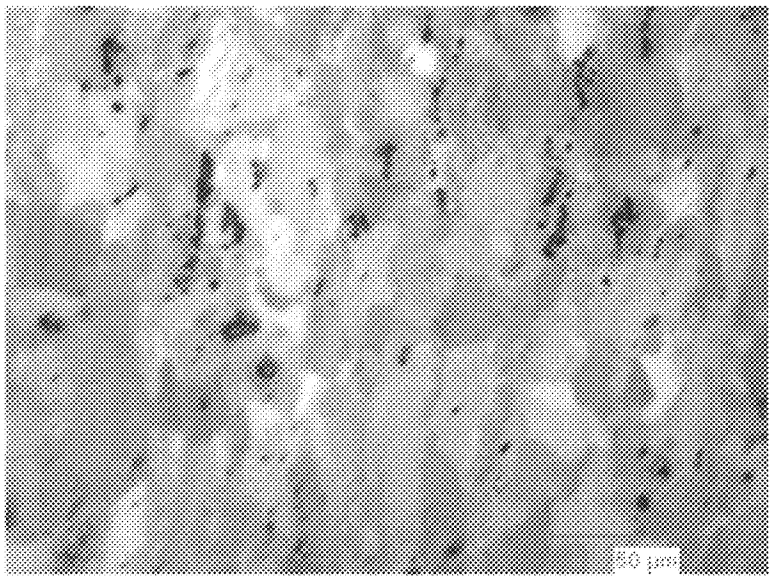
FIGS. 12A and 12B are optical microscopy images of an aluminum alloy that has been processed using exemplary methods disclosed herein.
Figure 12A:
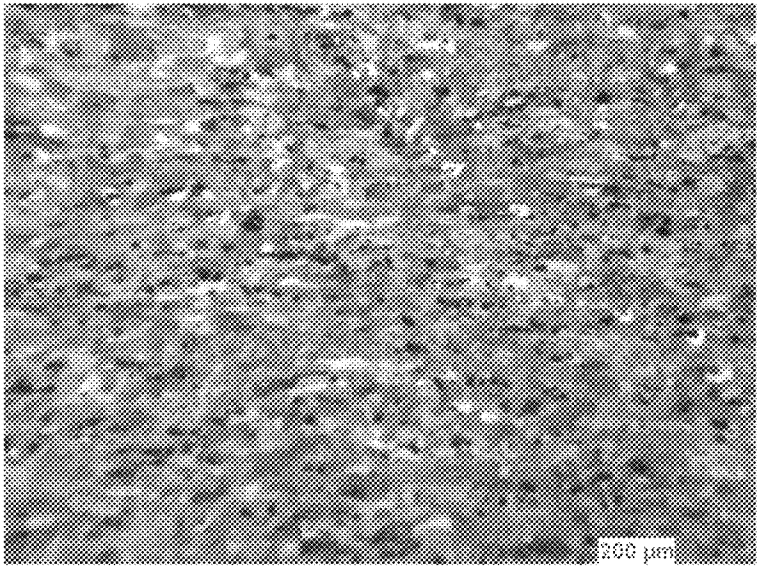

After the first ECAE process, solutionizing and quenching was carried out using the same conditions as described in Example 3 (i.e. the billet was held at 450° C. for 2 hours followed by immediate quenching in cold water). The microstructure of the resulting A17020 material was analyzed by optical microscopy and is shown in FIGS. 12A and 12B. FIG. 12A is the resulting material at ×100 magnification and FIG. 12B is the same material at ×400 magnification. As shown in FIGS. 12A and 12B, the resulting material consists of fine isotropic grain sizes of 10-15 μm throughout the material in all directions. This microstructure was formed during the high temperature solution heat treatment by recrystallization and growth of the submicron grains that were initially formed by the ECAE. As shown in FIGS. 12A and 12B, the resulting material contains grains that are much finer and the material possesses a better isotropy in all directions than the solutionized and quenched initial microstructure of Example 3.

After the solutionizing and quenching, the samples were again deformed via another process of ECAE, this time at a lower temperature than used in the first ECAE process. For comparison, the same process parameters used in Example 3 were used in this second ECAE process. The second ECAE process was performed at room temperature with two passes as soon as possible after the quench step (i.e. within 30 minutes of quenching). The overall ECAE processing was discovered to have improved results using the second ECAE process as the lower temperature ECAE process. In particular, unlike in Example 3, the billet in Example 4 did not crack after two ECAE passes conducted with the billet material at lower temperature. Table 4 shows tensile data collected after the sample material had been subjected to two ECAE passes.

TABLE 4

Results of Al7020 Material After Two ECAE Cycles, With Second ECAE Cycle Having Two Passes

| Number of ECAE passes | Brinell Hardness (HB) | YS (MPa) | UTS (MPa) | Surface condition |
|---|---|---|---|---|
| 2 | 133 | 416 | 440 | good |

As shown in Table 4, the resulting material also had a substantial improvement over material that has only had a T651 temper condition. That is, the A17020 material that underwent the two step ECAE process had a yield strength of 416 MPa and an ultimate tensile strength of 440 MPa.

Example 4 demonstrates that the grain size and isotropy of the material before ECAE can affect the processing results and ultimate attainable strength. ECAE at relatively moderate temperatures (around 175° C.) may be an effective method to break, refine and uniformize the structure of A17000 alloy material and make the material better for further processing. Other important factors for processing A17000 with ECAE are the stabilization of GP zone and precipitates prior to ECAE processing. This is described further in the following examples.

Example 5: ECAE of Artificially Aged A17020 Samples Having Only T651 Temper

In this Example, the A17020 alloy material of Example 1 was submitted to an initial processing that included solutionizing, quenching, stress relief by stretching to 2.2% greater than the starting length, and artificial peak aging. Artificial peak aging of this A17020 material consisted of a two-step procedure that included a first heat treatment at 90° C. for 8 hours followed by a second heat treatment at 115° C. for 40 hours, which is similar to a T651 temper for this material. Peak aging was started within a few hours after the quenching step. The Brinell hardness of the resulting material was measured at 108 HB and the yield strength was 347 MPa (i.e. similar to the material in Example 2). The first heat treatment step is used to stabilize the distribution of GP zones before the second heat treatment and to inhibit the influence of natural aging. This procedure was found to encourage homogeneous precipitation and optimize strengthening from precipitation.

Low temperature ECAE was then conducted after the artificial peak aging. Two ECAE process parameters were evaluated. First, the number of ECAE passes was varied. One, two, three, and four passes were tested. For all ECAE cycles, the material billets were rotated by 90 degrees between each pass. Second, the effect of material temperature during ECAE was varied. The ECAE die and billet temperatures evaluated were 25° C., 110° C., 130° C., 150° C., 175° C., 200° C., and 250° C. Both Brinell hardness and tensile data were taken with the sample material at room temperature after certain processing conditions in order to evaluate the effects on strengthening. Optical microscopy was used to create images of samples of the resulting material and is shown in FIGS. 13A and 13B.

As an initial observation, no cracking was observed in the material of any of the sample billets, even for billets that underwent ECAE processing at room temperature. This example contrasts with Example 3, where ECAE was conducted right after the unstable solutionized and quenched state and cracking occurred in the second and third samples. This result shows the effect of stabilization of GP zones and precipitates on the processing of A17000 alloy material. This phenomenon is very specific to A17000 alloys due to the nature and fast diffusion of the two main constitutive elements, Zinc and Magnesium.

Figure 13B:
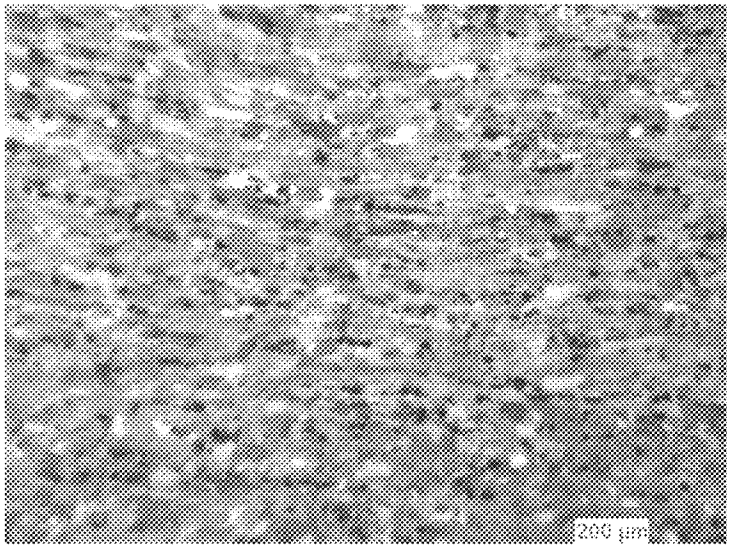
FIGS. 13A and 13B are optical microscopy images of an aluminum alloy that has been processed using exemplary methods disclosed herein.
Figure 13A:
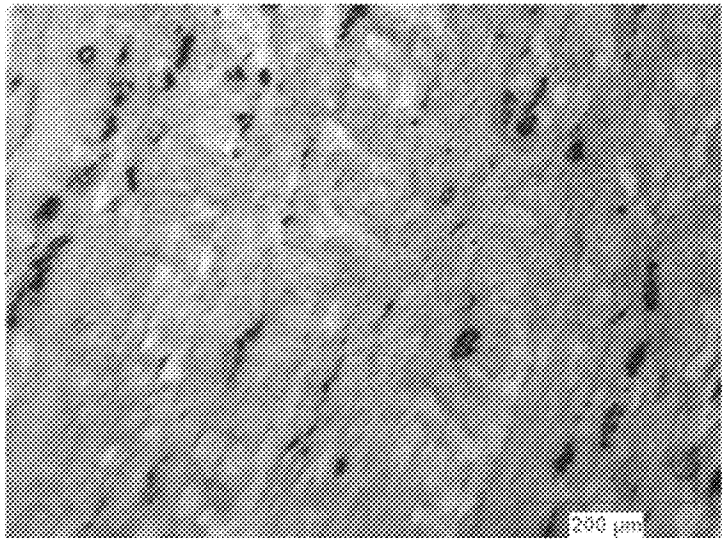

FIGS. 13A and 13B show typical microstructures after ECAE as analyzed by optical microscopy. FIG. 13A shows the material at room temperature after being subjected to four ECAE passes at room temperature and after being held at 250° C. for one hour. FIG. 13B shows the material at room temperature after being subjected to four ECAE passes at room temperature and after being held at 325° C. for one hour. From these images, it was discovered that the submicron grain size is stable up to about 250° C. In this temperature range, the grain size is submicron and too small to be resolved by optical microscopy. At about 300° C. to about 325° C., full recrystallization has occurred and the submicron grain size has grown into a uniform and fine recrystallized microstructure with grain sizes of about 5-10 μm. This grain size only grows slightly up to 10-15 μm after heat treatment as high as 450° C., which is in the typical temperature range for solutionizing (see Example 4). This structural study shows that hardening due to grain size refinement by ECAE will be most effective when ECAE is performed at temperature below about 250° C. to 275° C., i.e. when the grain size is submicron.

Table 5 contains the measured results of Brinnell hardness and tensile strength as a result of varying the temperature of the A17020 alloy material during ECAE.

TABLE 5

Effect of Billet Temperature During ECAE on Final Yield Strength

| Process | YS (MPa) | UTS (MPa) | YS % increase | UTS % increase |
|---|---|---|---|---|
| T651 temper | 347.8 | 396.5 | | |
| 4 ECAE pass at 125° C. | 417 | 474 | 19.9 | 19.5 |
| 4 ECAE pass at 100° C. | 447 | 483 | 28.5 | 21.8 |
| 4 ECAE pass at 25° C. | 488 | 493 | 40.3 | 24.3 |

Figure 14:
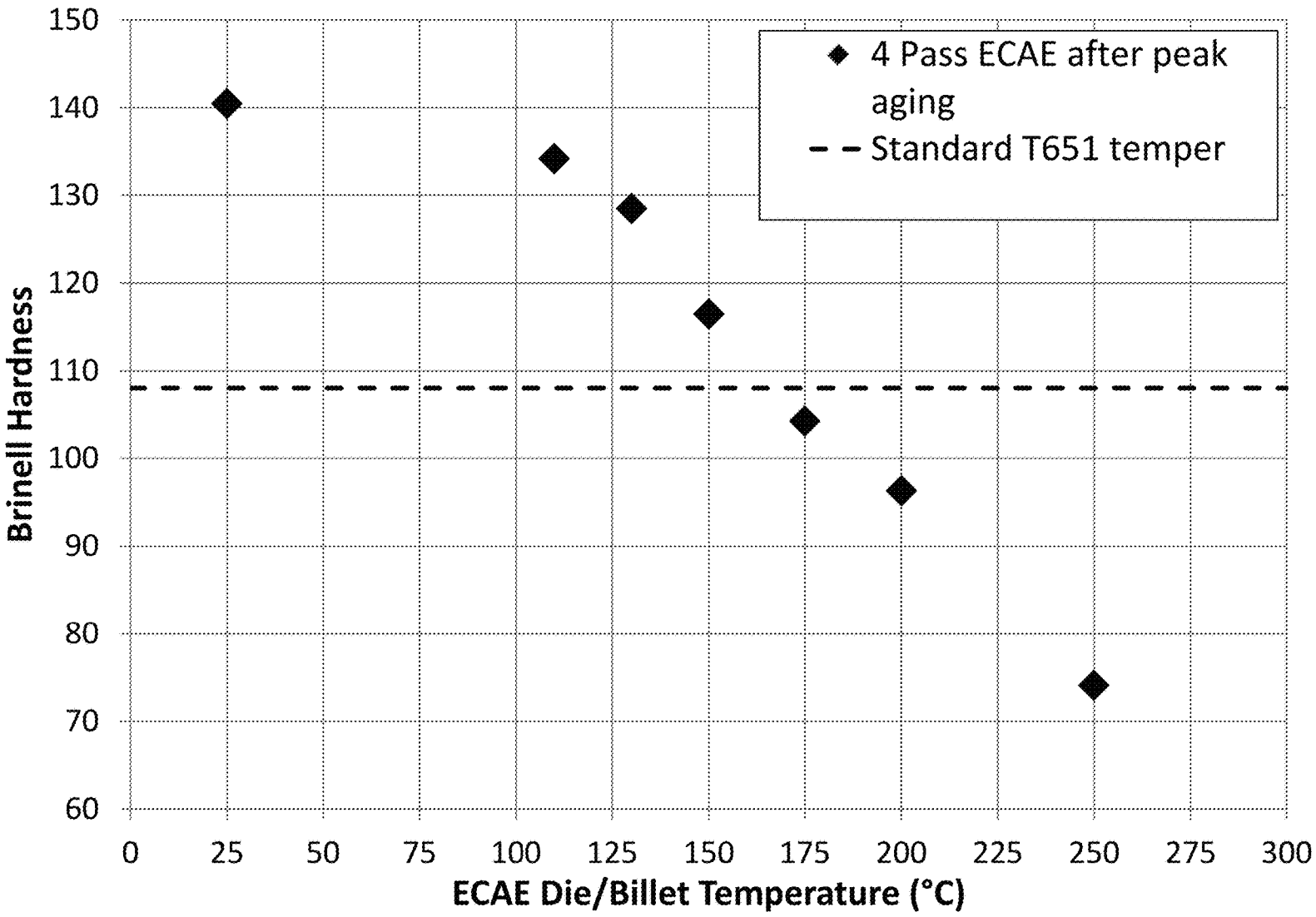
FIG. 14 is a graph comparing material temperature to Brinell hardness in an aluminum alloy processed using exemplary methods disclosed herein.
Figure 15:
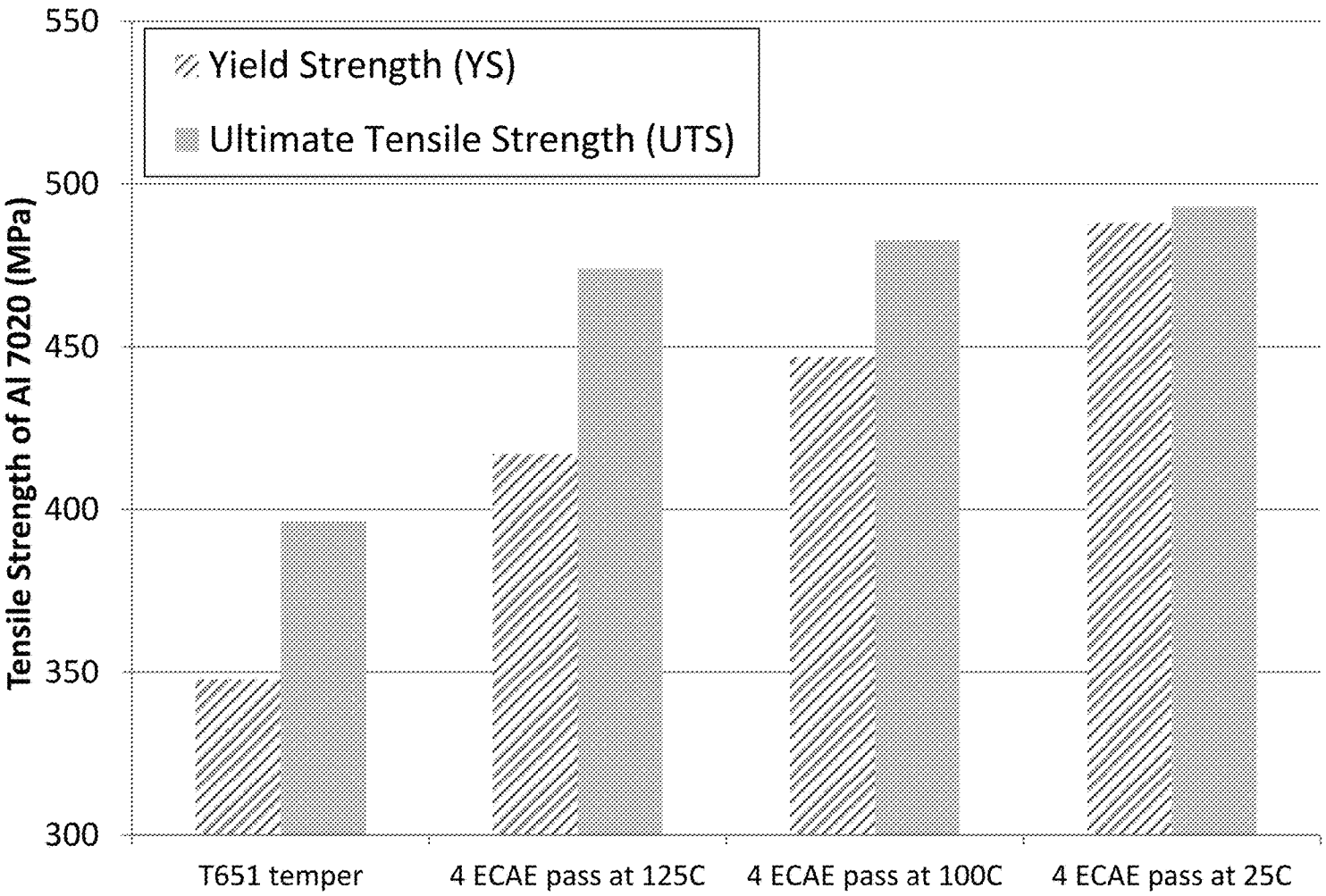
FIG. 15 is a graph comparing processing temperature to tensile strength in an aluminum alloy processed using exemplary methods disclosed herein.

FIGS. 14 and 15 show the measured results of the material formed in Example 5 as graphs showing the effect of ECAE temperature on the final Brinell hardness and tensile strength. All samples shown in FIGS. 14 and 15 were subjected to a total of 4 ECAE passes with intermediate annealing at a given temperature for short periods lasting between 30 minutes and one hour. As shown in FIG. 14, hardness was greater than material having only the T651 temper when the material underwent ECAE while the material temperature during extrusion was less or equal to about 150° C. Furthermore, strength and hardness was higher as the billet material processing temperature was reduced, with the greatest increase shown from 150° C. to about 110° C. The sample that had the greatest final strength was the sample that underwent ECAE with the billet material at room temperature. As shown in FIG. 15 and Table 5, this sample had a resulting Brinell hardness around 140 HB and YS and UTS equal to 488 MPa and 493 MPa respectively. This shows a nearly 40% increase in yield strength above material having only a standard T651 temper. Even at 110° C., which is near the peak aging temperature for this material, YS and UTS are respectively 447 MPa and 483 MPa. Some of these results can be explained as follows.

Holding the A17020 alloy material at temperatures from about 115° C. to 150° C. for a few hours corresponds to an overaging treatment in A17000 alloys when precipitates have grown larger than during conditions of peak aging, which gives peak strength. At temperatures of about 115° C. to about 150° C., the ECAE extruded material is still stronger than material having only undergone the T651 temper because the strength loss due to overaging is compensated by grain size hardening due to ECAE. The strength loss due to overaging is rapid, which explains the lowered final strength when the material is held at temperatures increasing from 110° C. to about 150° C., as shown in FIG. 14. Above about 200° C. to about 225° C., strength loss is not only caused by overaging but also by the growth of the submicron grain size. The effect is also observed at temperatures above 250° C. where recrystallization starts to occur.

Temperatures around 110° C. to about 115° C. are near the conditions for peak aging of A17000 (i.e. the T651 temper) and the increased strength above the strength of material having only a T651 temper is due mainly to grain size and dislocation hardening by ECAE. When the A17020 alloy material is at temperatures below about 110° C. to about 115° C., precipitates are stable and in the peak aged condition. As the material is lowered to temperatures near room temperature, ECAE hardening becomes more effective because more dislocations and finer submicron grain sizes are created. The rate of strength increase when the material is processed around room temperature is more gradual compared to temperatures between about 110° C. and 150° C.

Figure 16:
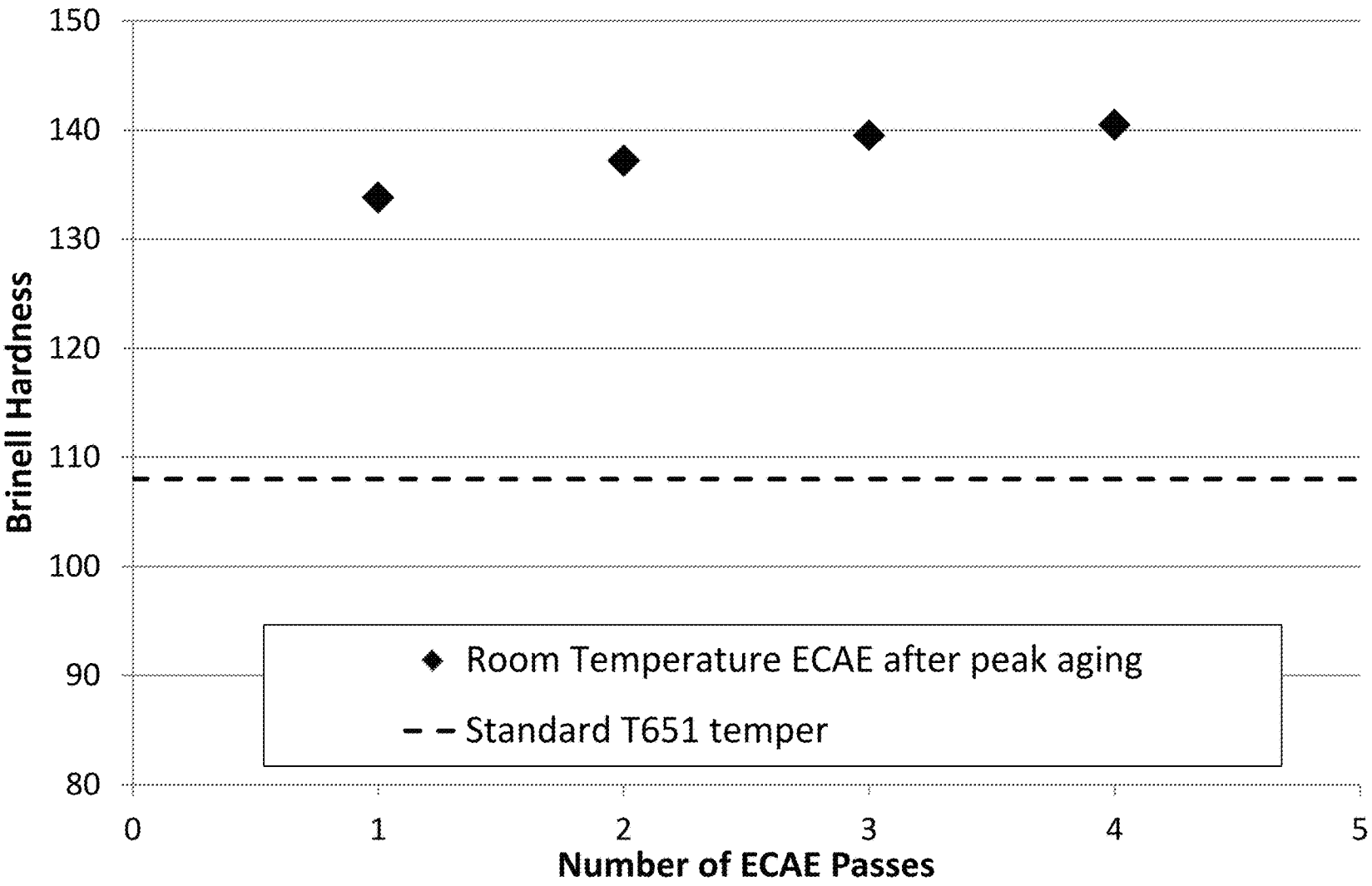
FIG. 16 is a graph comparing the number of extrusion passes to the resulting Brinell hardness of an aluminum alloy processed using exemplary methods disclosed herein.
Figure 17:
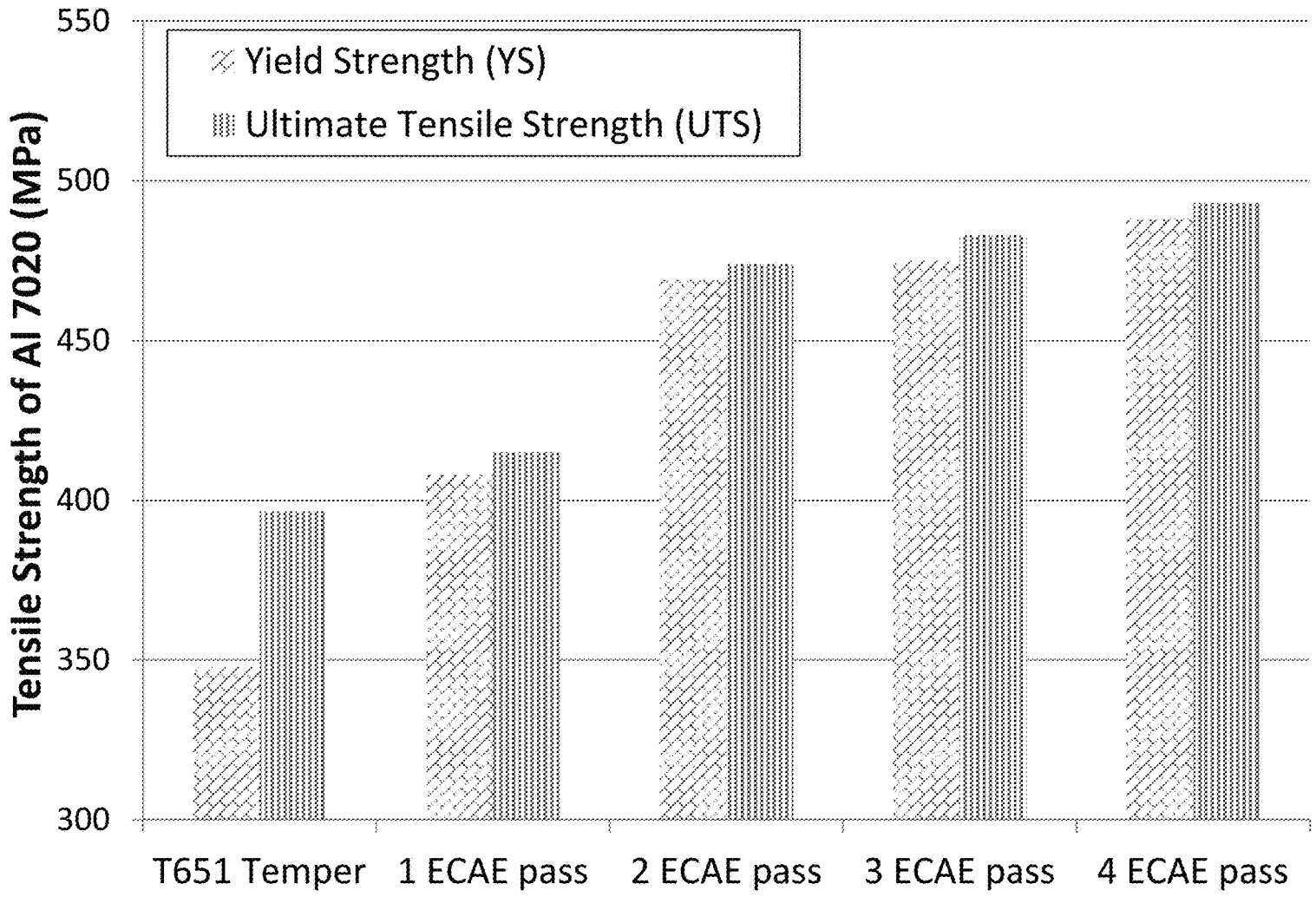
FIG. 17 is a graph comparing the number of extrusion passes to the resulting tensile strength of an aluminum alloy processed using exemplary methods disclosed herein.

FIGS. 16 and 17 and Table 6 show the effect of the number of ECAE passes on the attainable strength of the A17020 alloy.

TABLE 6

Effect of Number of ECAE Passes on Final Yield Strength

| Process | YS (MPa) | UTS (MPa) | YS % increase | UTS % increase |
|---|---|---|---|---|
| T651 Temper | 347.8 | 396.5 | | |
| 1 ECAE pass | 408 | 415 | 17.3% | 4.7% |
| 2 ECAE pass | 469 | 474 | 34.8% | 19.5% |
| 3 ECAE pass | 475 | 483 | 36.6% | 21.8% |
| 4 ECAE pass | 488 | 493 | 40.3% | 24.3% |

The samples used to create the data in the graphs of FIGS. 16 and 17 were extruded with the sample material at room temperature and the billet was rotated by 90 degrees between each pass. A gradual increase in strength and hardness was observed with an increasing number of ECAE passes. The largest increase in strength and hardness occurred after the material had undergone between one and two passes. In all cases, the final yield strength was over 400 MPa, specifically 408 MPa, 469 MPa, 475 MPa and 488 MPa after one, two, three and four passes respectively. This example shows that the mechanisms of refinement into submicron grain size that include dislocation generation and interaction and creation of new grain boundaries become more effective with increasing levels of deformation by simple shear during ECAE. A lower billet material temperature during ECAE can also lead to increased strengths as described earlier.

As shown in Example 5, improvements in strength were achieved without cracking the material by performing ECAE after artificial aging that used a two-step aging procedure to stabilize GP zones and precipitates. Avoiding cracking of the billet enables a lower ECAE processing temperature and allows for a higher number of ECAE passes to be used. As a consequence, higher strengths can be formed in the A17020 alloy material.

Example 6: Comparison of Various Processing Routes

Figure 18:
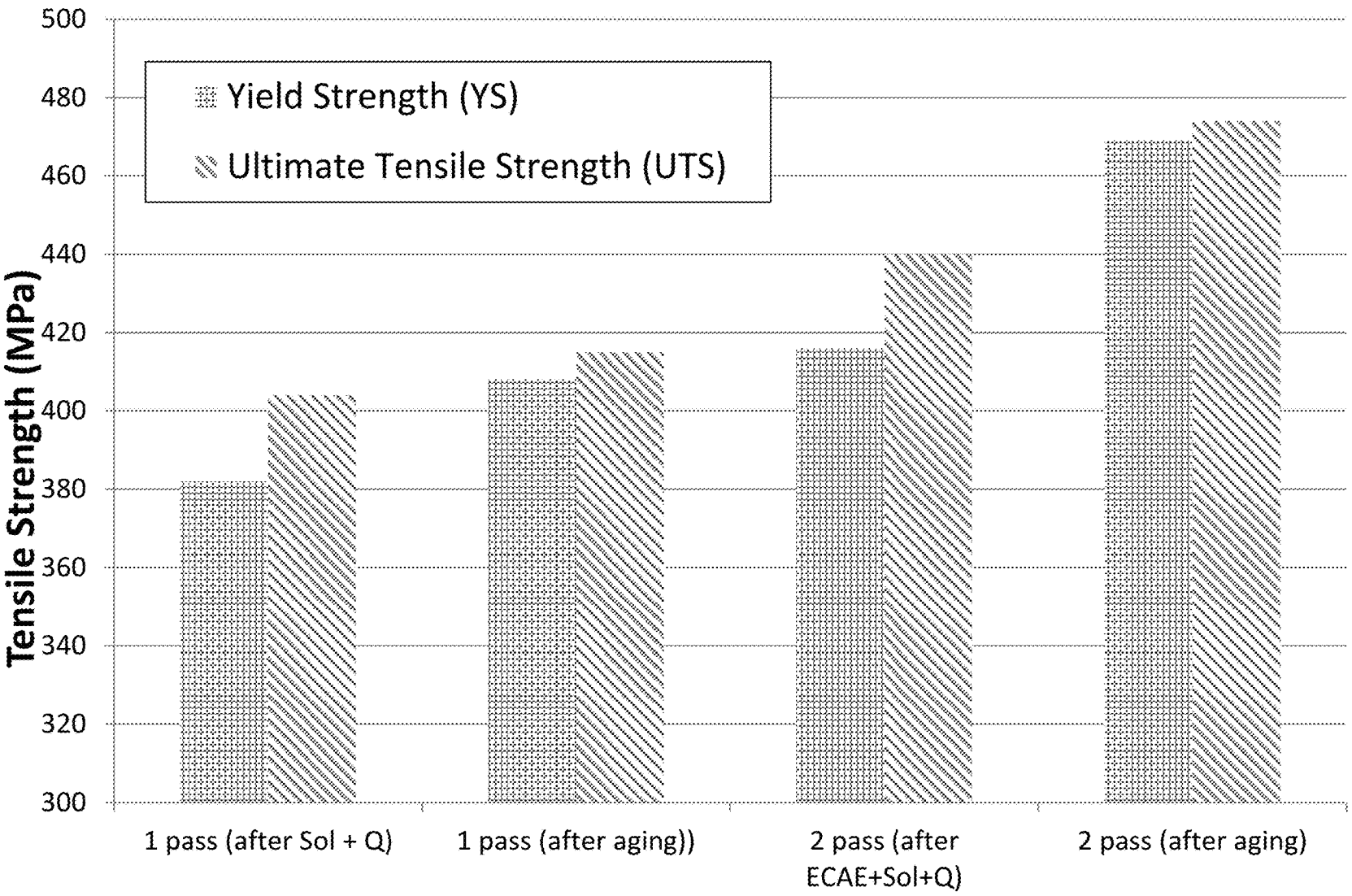
FIG. 18 is a graph comparing various processing routes to the resulting tensile strength of an aluminum alloy processed using exemplary methods disclosed herein.

Table 7 and FIG. 18 display strength data comparing the various processing routes described in Examples 3, 4 and 5. Only the samples that were subjected to ECAE at room temperature are compared, showing one and two passes.

TABLE 7

Comparison of Final Strength in Al7020 After Various Processing Routes

| | | YS (MPa) | UTS (MPa) |
|---|---|---|---|
| Example 3 | 1 ECAE pass after solutionizing and quenching | 382 | 404 |
| Example 5 | 1 ECAE pass after aging | 408 | 415 |
| Example 4 | 2 ECAE passes after initial ECAE and solutionizing and quenching | 416 | 440 |
| Example 5 | 2 ECAE passes after aging | 469 | 474 |

As shown in FIG. 18 and Table 7, applying ECAE to A17020 alloy material samples that have both been solutionized and aged (i.e. Examples 3 and 4) does not result in as high a final strength when compared to applying ECAE to artificially aged samples (i.e. Example 5) for the same given number of passes. Namely, compare 382 MPa (Example 3) to 408 MPa (Example 5) for one ECAE pass and 416 MPa (Example 4) to 469 MPa (Example 5) for two passes. This comparison shows that standard cold working of solutionized and quenched A17000 is generally not as effective as, for example, for A12000 series alloys. This is generally attributed to a coarser precipitation on dislocation. This trend appears to apply also to extreme plastic deformation for A17000 series alloys at least for the first two passes. This comparison indicates that a processing route that involves stabilization of precipitation by artificial aging before applying ECAE has more advantages than a route using ECAE directly after the solutionizing and quenching steps. The advantages have been shown to lead to better surface conditions, such as less cracking, for the material being extruded and allow the material to reach a higher strength for a given deformation level.

Example 7: Result of Conducting ECAE on A17020 Plates

Figure 19:
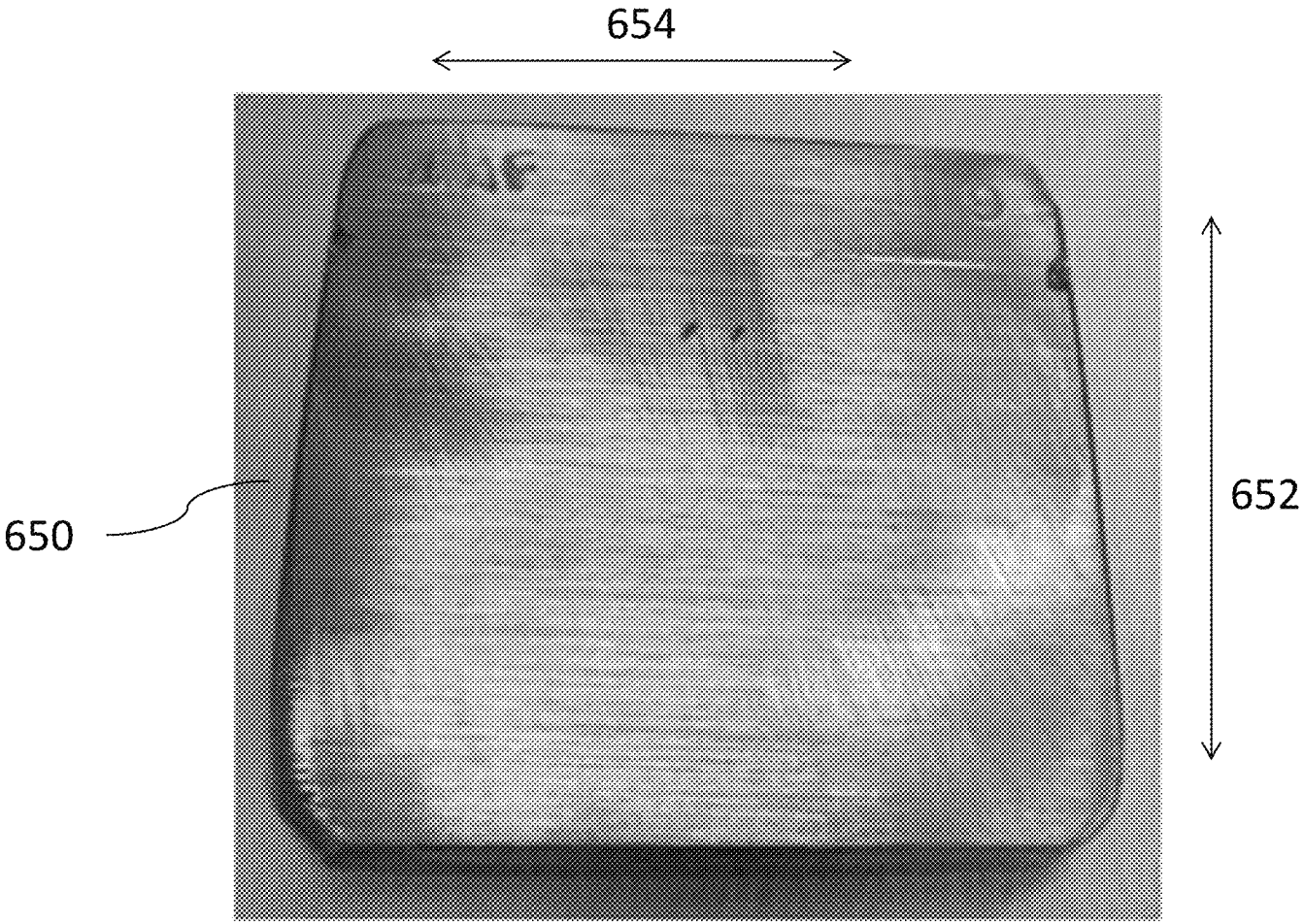
FIG. 19 is a photograph of an aluminum alloy that has been processed using exemplary methods disclosed herein.

The procedure described in Example 5 was applied to material formed into plates rather than bars, as shown in FIG. 10. FIG. 19 shows an example plate 650 having a length 652, a width 654, and a thickness less than either the length 652 or width 654. In some embodiments, the length 652 and width 654 may be substantially the same such that the plate is a square in the plane parallel to the length 652 and the width 654. Often the length 652 and width 654 are substantially larger than the thickness, for example, by a factor of three. This shape may be more advantageous for applications such as portable electronic device casings as it is a near net shape. ECAE was conducted after the same initial thermomechanical property treatment used in Example 5: solutionizing, quenching, stress relief by stretching to 2.2% and a two-step peak aging comprising a first heat treatment at 90° C. for 8 hours followed by a second heat treatment at 115° C. for 40 hours. The plate 650 in FIG. 19 is a plate of A17020 alloy shown after the material was subjected to ECAE.

Workability of the plate 650 was good with no severe cracking at all temperatures, including at room temperature. The results of hardness and strength testing of the plate 650 are contained in Table 8. As shown in Table 8, hardness and strength tests were taken after applying one, two, and four ECAE passes and tensile data after two and four ECAE passes. Table 8 shows that the results of applying ECAE to plates were similar to those for ECAE bars. In particular, yield strength (YS) in the material that was extruded as a plate was well above 400 MPa.

TABLE 8

Measured Values for Plates After ECAE is Applied

| | Brinell Hardness (HB) | YS (MPa) | UTS (MPa) |
|---|---|---|---|
| 1 ECAE pass | 130 | n/a | n/a |
| 2 ECAE pass | 133.5 | 452 | 456 |
| 4 ECAE pass | 140.6 | 490 | 502 |

Example 8: Effect of Rolling after ECAE

Figure 20B:
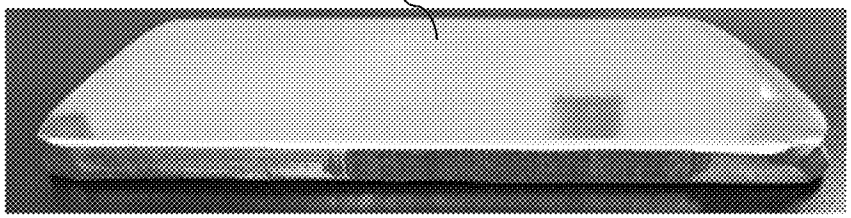
FIGS. 20A and 20B are photographs of an aluminum alloy that has been processed using exemplary methods disclosed herein.
Figure 20A:
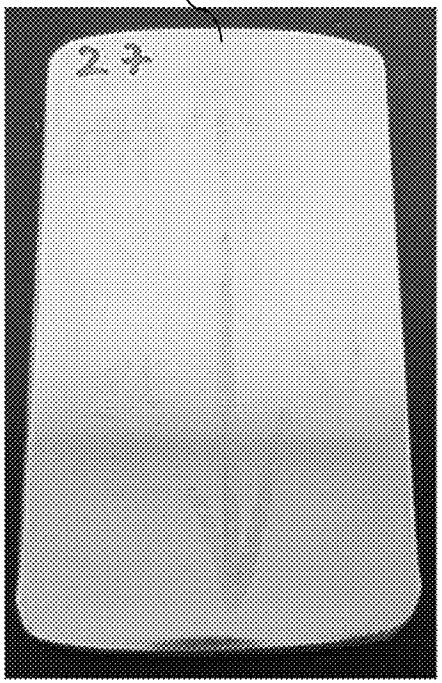

FIGS. 20A and 20B show A17020 alloy material that has undergone ECAE with the material formed as a plate 660. After ECAE, the plate 660 was rolled. Rolling reduced the thickness of the plate up to 50%. When multiple rolling passes are used to gradually reduce the thickness to a final thickness, the mechanical properties are often slightly better during the final rolling step as compared to the initial rolling pass after the plate 660 has undergone ECAE, as long as rolling is conducted at relatively low temperatures close to room temperature. This example demonstrates that an aluminum alloy having Magnesium and Zinc that has undergone ECAE has the potential to undergo further processing by conventional thermomechanical processing to form a final desirable near net shape if needed. Some example thermomechanical processing steps may encompass rolling, forging, stamping or standard extrusion, for example, as well as standard machining, finishing and cleaning steps.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A method of forming a high strength aluminum alloy, the method comprising:

heating an aluminum material containing magnesium, zinc and less than 0.5 wt. % copper to a solutionizing temperature such that the magnesium and zinc are dispersed throughout the aluminum material to form a solutionized aluminum material;

quenching the solutionized aluminum material to below about room temperature such that the magnesium and zinc remain dispersed throughout the solutionized aluminum material to form a quenched aluminum material;

aging the quenched aluminum material to form an aluminum alloy, wherein the aging step includes heating the quenched aluminum material to a temperature from about 88° C. to about 92° C. for from about seven hours to about nine hours followed by heating the aluminum alloy to a temperature from about 110° C. to about 120° C. for from about 35 hours to about 45 hours; and subjecting the aluminum alloy to an equal channel angular extrusion (ECAE) process while maintaining the aluminum alloy at a temperature to produce a high strength aluminum alloy having a yield strength from about 400 MPa to about 650 MPa.

2. The method of claim 1, wherein the heating step includes heating the aluminum material to a temperature from about 400° C. to about 550° C. for from about 3 hours to about 24 hours.

3. The method of claim 1, wherein the aluminum material contains aluminum as a primary component, from about 0.5 wt. % to about 4.0 wt. % Magnesium and from about 2.0 wt. % to about 7.5 wt. % Zinc.

4. The method of claim 1, wherein the high strength aluminum alloy has an average grain size from about 0.2 μm to about 0.8 μm.

5. The method of claim 1, wherein the ECAE process includes at least two ECAE passes.

6. The method of claim 1, further comprising subjecting the aluminum material to a first ECAE process before the heating step, wherein the aluminum material is maintained at a temperature from about 100° C. to about 400° C. during the ECAE process.

7. The method of claim 1, wherein the high strength aluminum alloy has a grain size less than 1 micron in diameter.

8. A method of forming a high strength aluminum alloy, the method comprising:

subjecting an aluminum material containing magnesium, zinc and less than 0.5 wt. % copper to a first equal channel angular extrusion (ECAE) process, wherein the aluminum material is maintained at a temperature from about 100° C. to about 400° C. during the first ECAE process;

after the first ECAE process, heating the aluminum material to a solutionizing temperature such that the magnesium and zinc are dispersed throughout the aluminum material to form a solutionized aluminum material;

quenching the solutionized aluminum material to below about room temperature such that the magnesium and zinc remain dispersed throughout the solutionized aluminum material to form a quenched aluminum material; and subjecting the quenched aluminum material to an additional ECAE process while maintaining the aluminum material at a temperature from about 20° C. to about 150° C. to produce a high strength aluminum alloy having a yield strength from about 400 MPA to about 650 MPa.

9. The method of claim 8, wherein the heating step includes heating the aluminum material to a temperature from about 400° C. to about 550° C. for from about 3 hours to about 24 hours.

10. The method of claim 8, wherein the aluminum material contains aluminum as a primary component, from about 0.5 wt. % to about 4.0 wt. % Magnesium and from about 2.0 wt. % to about 7.5 wt. % Zinc.

11. The method of claim 8, further comprising aging the quenched aluminum material prior to the additional ECAE process, wherein the aging step includes heating the aluminum material to a temperature from about 80° C. to about 100° C. for from about one hour to about eight hours followed by heating the aluminum alloy to a temperature from about 110° C. to about 120° C. for from about 35 hours to about 45 hours.

12. The method of claim 8, wherein the high strength aluminum alloy has an average grain size from about 0.2 μm to about 0.8 μm.

13. A method of forming a high strength aluminum alloy, the method comprising:

heating an aluminum material containing magnesium, zinc and less than 0.5 wt. % copper to a solutionizing temperature such that the magnesium and zinc are dispersed throughout the aluminum material to form a solutionized aluminum material;

quenching the solutionized aluminum material to below about room temperature such that the magnesium and zinc remain dispersed throughout the solutionized aluminum material to form a quenched aluminum material;

aging the quenched aluminum material to form an aluminum alloy, wherein the aging step includes heating the quenched aluminum material to a temperature from about 88° C. to about 92° C. for from about seven hours to about nine hours followed by heating the aluminum alloy to a temperature from about 110° C. to about 120° C. for from about 35 hours to about 45 hours; and subjecting the aluminum alloy to an equal channel angular extrusion (ECAE) process while maintaining the aluminum material at a temperature from about 20° C. to about 150° C. to produce a high strength aluminum alloy having a yield strength from about 400 MPA to about 650 MPa.

14. The method of claim 13, further comprising subjecting the aluminum material to an additional ECAE process before the heating step, wherein the aluminum material is maintained at a temperature from about 100° C. to about 400° C. during the additional ECAE process.

15. The method of claim 13, wherein the aluminum material contains aluminum as a primary component, from about 0.5 wt. % to about 4.0 wt. % Magnesium and from about 2.0 wt. % to about 7.5 wt. % Zinc.

16. The method of claim 13, wherein the high strength aluminum alloy has an average grain size from about 0.2 μm to about 0.8 μm.

17. The method of claim 13, wherein the high strength aluminum alloy has a grain size less than 1 micron in diameter.

18. The method of claim 13, wherein the ECAE process includes at least two ECAE passes.

19. The method of claim 13, wherein the high strength aluminum alloy has a yield strength from about 420 MPa to about 500 MPa.

20. The method of claim 13, wherein the high strength aluminum alloy has a yield strength from about 420 MPa to about 500 MPa.

* * * * *